US007770936B2

(12) United States Patent
Koch et al.

(10) Patent No.: US 7,770,936 B2
(45) Date of Patent: Aug. 10, 2010

(54) MULTIPLE COUPLING LOCKS AND MULTIPLE DOCKING DEVICES CONTAINING SAID MULTIPLE COUPLING LOCKS

(75) Inventors: Martin Koch, Neuenburg-Griβheim (DE); Joachim Stoye, Neuenburg-Griβheim (DE); Stefan Vogler, Aachen (DE)

(73) Assignee: GEA Buck Valve GmbH (DE)

( * ) Notice: Subject to any disclaimer, the term of this patent is extended or adjusted under 35 U.S.C. 154(b) by 722 days.

(21) Appl. No.: 10/557,693

(22) PCT Filed: Jul. 30, 2004

(86) PCT No.: PCT/DE2004/001721

§ 371 (c)(1),
(2), (4) Date: Feb. 21, 2007

(87) PCT Pub. No.: WO2005/012104

PCT Pub. Date: Feb. 10, 2005

(65) Prior Publication Data

US 2007/0191167 A1 Aug. 16, 2007

(30) Foreign Application Priority Data

Aug. 1, 2003 (DE) ..... 103 35 325

(51) Int. Cl.
*F16L 21/00* (2006.01)

(52) U.S. Cl. ..... 285/235; 141/10; 141/314; 383/61.2; 383/78

(58) Field of Classification Search ..... 285/3, 285/227, 229, 235, 236; 141/10, 114, 314, 141/382, 383, 386; 383/61.2, 78, 80, 87
See application file for complete search history.

(56) References Cited

U.S. PATENT DOCUMENTS

| | | | | |
|---|---|---|---|---|
| 4,019,512 | A * | 4/1977 | Tenczar | 604/411 |
| 4,022,205 | A * | 5/1977 | Tenczar | 604/411 |
| 4,030,494 | A * | 6/1977 | Tenczar | 604/411 |
| 4,187,846 | A * | 2/1980 | Lolachi et al. | 604/411 |
| 4,219,221 | A * | 8/1980 | Webb | 285/3 |
| 4,564,054 | A * | 1/1986 | Gustavsson | 141/329 |
| 4,610,469 | A * | 9/1986 | Wolff-Mooij | 285/260 |
| 5,117,875 | A * | 6/1992 | Marrucchi | 141/1 |
| 5,348,063 | A * | 9/1994 | Handleman | 141/314 |

(Continued)

FOREIGN PATENT DOCUMENTS

DE 43 29 276 3/1995

(Continued)

*Primary Examiner*—David E Bochna
(74) *Attorney, Agent, or Firm*—Schiff Hardin LLP

(57) ABSTRACT

In a multiple coupling lock system and method for an environmentally sealed filling or refilling of a first container or a first hose, a first coupling lock has an opening area which is opened. A first flexible conveyance unit has a first end connected to the first coupling lock in an environmentally sealed manner. A second opposite end of the first flexible conveyance unit connects to a second coupling lock in an environmentally sealed manner, the opening area of the first coupling lock being sufficiently large when opened to allow the second coupling lock to pass therethrough. The second coupling lock connects in an environmentally sealed manner to the first container or first hose. The system or method provides the ability to environmentally fill or refill the first container or first hose-in an environmentally sealed manner.

18 Claims, 15 Drawing Sheets

U.S. PATENT DOCUMENTS

| | | | | |
|---|---|---|---|---|
| 5,379,810 | A * | 1/1995 | Marino | 141/10 |
| 5,832,973 | A * | 11/1998 | Goldschmidt et al. | 141/383 |
| 6,068,031 | A * | 5/2000 | Lataix et al. | 141/346 |
| 6,132,089 | A * | 10/2000 | Galomb et al. | 383/63 |
| 6,679,529 | B2 * | 1/2004 | Johnson et al. | 285/423 |
| 7,300,207 | B2 * | 11/2007 | Linneweil | 383/35 |
| 7,487,808 | B2 * | 2/2009 | Stoye et al. | 141/315 |
| 2005/0084181 | A1 | 4/2005 | Koch et al. | |

FOREIGN PATENT DOCUMENTS

| | | |
|---|---|---|
| DE | 198 06 932 | 9/1999 |
| DE | 201 17 669 | 4/2002 |
| EP | 0 554 096 | 10/1998 |
| GB | 2 291 863 | 2/1996 |

* cited by examiner

MULTIPLE COUPLING LOCKS AND MULTIPLE DOCKING DEVICES CONTAINING SAID MULTIPLE COUPLING LOCKS

BACKGROUND

The present preferred embodiment relates to a multiple coupling lock, a multiple docking device containing said multiple coupling lock, a container and conveyance system, in each case comprising a multiple coupling lock, a procedure in particular for the filling, refilling and/or emptying of flexible or rigid containers in an environmentally sealed manner using the multiple coupling locks, and the use of said multiple coupling locks for the environmentally sealed filling, refilling or emptying of flexible containers in particular.

Fluid or solid bulk materials are created as interim or end products during a large number of procedures, and, insofar as they are not conveyed to their intended location or final destination via pipe systems, must be moved and brought into the transport system in the form of packing drums of a specific size. Since some products have a highly toxic effect on the human organism, even in small quantities, or react highly sensitively to the air or humidity, very high standards in terms of environmental sealing must be set when refilling products of this nature, e.g. for the purpose of further processing them into interim or end products. As well as avoiding the contamination of the environment, high standards with regard to the purity of the initial or interim products used are also set, particularly in the further processing industry, for which reason contamination from external impurities must be avoided at every stage during the procedure, and not only during the manufacture and separation of the initial products. The risk of contaminating the environment or products is particularly high specifically during the refilling procedure, which is why these working stages are frequently conducted under superclean conditions, for example in the pharmaceutical industry. The necessity of working in a contamination-free environment leads to high levels of expenditure in terms of apparatus and safety technology, particularly in the food processing, chemical or pharmaceutical industries, which in turn inevitably affects manufacturing costs.

In order to fill, empty or refill a container in an environmentally sealed or at least dust-free manner, the double valve method is currently frequently used, as described in DE 695 04 581 T2, for example. Docking devices of this type which use the double valve method have highly complex structures and therefore regularly entail high levels of expenditure.

Docking devices with a simpler type of structure can be created according to DE 196 24 189 A1 from a first docking element which has a funnel shape, and a second docking element which is connected to the funnel-shaped docking element in a form-fit manner, in particular forming a spherical contact area. In order to ensure gas impermeability, the contact area must have a rubber elastic surface. Although it is possible to refill flowing media using the docking device described in DE 196 24 189 A1, it cannot be guaranteed that these flowing media do not enter the environment when coupling or decoupling the docking elements.

PCT/EP01/12011 describes a sealed docking device between two essentially environmentally insulated containers, which are connected via two coupling elements which can be elastically re-shaped. Each of these coupling elements comprises one slit, which is closed in its basic state, and which can be opened through the application of pressure. The containers to be filled or emptied must be attached in the area of the slit, or to the walls of the slit of the appropriate coupling element. With this docking device design, particular care must be taken to ensure that the slits of the coupling elements which are adjacent to each other are of the same length, and that they are positioned precisely one on top of the other.

In the unpublished German patent application with the file reference number 103 21 814.9, a coupling element for the environmentally insulated refilling, filling and/or emptying of containers is disclosed, which is essentially comprised of two locking bands which are positioned flush with each other, and which comprise join elements at their ends which interlock with each other, and which can be rotated around shared bearing axis elements. The join axis elements or join caps must precisely match the bearing elements of the locking bands with regard to their form and size, in order to be able to reliably function as pivot bearings on a long-term basis. With this construction, great care must be taken under certain refilling conditions, e.g. in relation to the type of bulk material, to ensure that no bulk material remains between the terminal sections of the locking bands which are opposite each other. Opening and closing this coupling element causes the opposing join elements to move towards or away from each other. Here, the structure permits the achievement of only a limited opening angle.

SUMMARY

It would therefore be desirable to have available coupling elements and docking devices which guarantee environmentally sealed refilling or filling with both small and large packing drums. It would furthermore be desirable to be able to further reduce the risk of contamination when filling or emptying, or when coupling or decoupling coupling elements, particularly with the additional use of structurally simple solutions which do not involve high cost levels.

In a multiple coupling lock system and method for an environmentally sealed filling or refilling of a first container or a first hose, a first coupling lock has an opening area which is opened. A first flexible conveyance unit has a first end connected to the first coupling lock in an environmentally sealed manner. A second opposite end of the first flexible conveyance unit connects to a second coupling lock in an environmentally sealed manner, the opening area of the first coupling lock being sufficiently large when opened to allow the second coupling lock to pass therethrough. The second coupling lock connects in an environmentally sealed manner to the first container or first hose. The system or method provides the ability to fill or refill the first container or first hose in an environmentally sealed manner.

DESCRIPTION OF THE PREFERRED EMBODIMENTS

Figure 1:
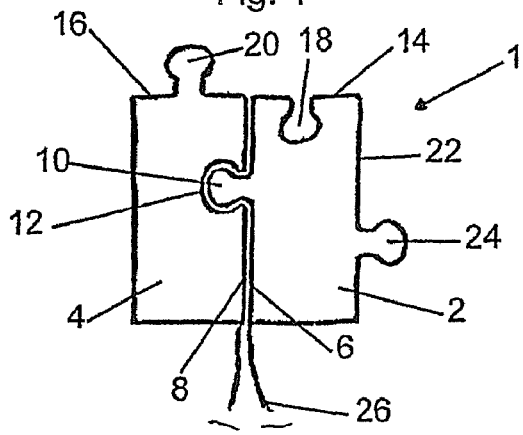
FIG. 1 shows a schematic profile view of a first coupling lock.

For the purposes of promoting an understanding of the principles of the invention, reference will now be made to the preferred embodiments illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

In the preferred embodiment a multiple coupling lock is provided for the locking in an essentially environmentally sealed manner of and/or for the filling and/or refilling in an essentially environmentally sealed manner of bulk materials from flexible and/or rigid containers or conveyance unit, in particular hose sections, comprising at least two coupling locks, which are in each case connected with each other, or can be connected with each other, in an environmentally sealed manner via a conveyance unit which is at least flexible and/or rigid in sections, in particular a hose, the opening area, in particular the inner diameter, of an opened, first coupling lock, also known as the outer coupling lock, being larger than the area of the outer circumference and/or opening, in particular the outer and/or inner diameter, of a second coupling lock, also known as the inner coupling lock, it being possible to dock the second coupling lock, in particular in an environmentally sealed manner, and when the first coupling lock is open, to a corresponding coupling lock which is located within the unit conveyance and/or which permeates through the opening of the first coupling lock at least in sections, thus forming a docking device.

Coupling locks such as those described in the preferred embodiment are designed to adopt at least a dual function. On the one hand, they can be a locking mechanism which can be brought from an opened or a closed position, or vice-versa. On the other hand, these coupling locks are designed and suitable for the purpose of being coupled with corresponding coupling locks, thus forming a docking device which is in particular environmentally sealed. Here, for example, the corresponding coupling lock can have an identical or mirror symmetrical design in relation to the coupling lock to be coupled. Alternatively, the coupling locks to be coupled can deviate from each other in terms of their design and/or their technical characteristics, although not to a degree which would no longer permit coupling or decoupling. In general, these coupling locks can be coupled with each other to form a docking device and then decoupled in both an open and a closed state. Furthermore, these coupling locks can be designed in such a manner that when they have in each case been coupled in a closed state, they can be opened in sequence or simultaneously. It is appropriate for coupling locks of the type described in the preferred embodiment to be positioned at the openings of containers, packing drums or conveyance unit such as hoses, and are connected with these, in particular in a sealed manner. In this way, when the coupling lock of the container is actuated, the packing drum or means of conveyance can be opened or closed and coupled with a container, packing drum or means of conveyance which is fitted with a corresponding coupling lock to form a docking device.

The adjacent first, or outer, and second, or inner, coupling locks of a multiple coupling lock according to the preferred embodiment, which are connected via a conveyance unit, are designed to be coupled in particular with a corresponding multiple coupling lock to form a multiple docking device. Here, the first, or outer, coupling locks on two corresponding multiple coupling locks according to the preferred embodiment to form a first, or outer, docking device when coupled, while the related second, or inner, coupling locks to form a second, or inner, docking device when coupled. In order to achieve this, the means of conveyance is attached to the first coupling lock, and a multiple coupling lock according to the preferred embodiment is attached to the second coupling lock in such a manner that first or second coupling locks can easily be coupled to a corresponding multiple coupling lock.

For example, the conveyance unit can be connected in one section, in particular in an environmentally sealed manner, with the first, or outer, coupling lock, which is positioned at a distance from the components of this coupling lock which are required for coupling or docking, in particular in an environmentally sealed manner. The same applies to the connection of the conveyance unit to the second, or inner, coupling lock of the multiple coupling lock according to the preferred embodiment. The second coupling locks of the multiple coupling lock according to the preferred embodiment are generally either connected, in each case in an environmentally sealed manner, with a container or an additional means of conveyance, into or out of which the bulk materials can be transferred.

The multiple coupling locks according to the preferred embodiment comprise a first, or outer, coupling lock which forms the inlet opening, and a second, or inner, coupling lock to which a container or conveyance unit, such as a hose, is fitted. With the multiple coupling locks according to the preferred embodiment, adjacent coupling locks are designated in such a way that the lock with the larger inner diameter or the larger opening area is the first, or outer, coupling lock, and the lock with the smaller inner area or opening area is the second, or inner, coupling lock. Naturally, the adjacent first and second coupling locks within a multiple coupling lock according to the invention can have either an identical design or a different design. It is also possible that when more than two coupling locks form a multiple coupling lock according to the preferred embodiment, the conveyance unit or hoses which connect the adjacent coupling locks can be of an identical or a different design, for example with regard to their type, size or length.

According to a principle of the preferred embodiment, adjacent first, or outer, and second, or inner, coupling locks are connected with each other within a multiple coupling lock via a flexible or rigid means of conveyance. Naturally, this also comprises conveyance unit which has partially flexible and partially rigid sections. This conveyance unit, which is in most cases a hose or pipes, but can be other devices, preferably comprises a material which is impermeable to bulk materials such as powder or granulate. If necessary, this conveyance unit can also be impermeable, in a preferred design, to fluids and/or gas, e.g. it can be impermeable to oxygen. Flexible, adjacent coupling locks on conveyance units which connect a multiple coupling lock have the advantage that the adjacent coupling locks can be moved relative to each other, preferably to the extent that the second, or inner, coupling lock can be guided, at least partially, through the opened adjacent first, or outer, coupling lock. In order to provide suitably tight environmental sealing, these conveyance unit are preferably closely connected at each of their openings or opening edges with the first or second coupling lock. The tight connection between the conveyance unit and the first and second coupling lock can be produced, for example, using suitable adhesive and/or welding methods.

Suitable conveyance units are preferably transparent, at least in parts, in order for it to be possible to detect from outside residues of bulk materials which have been left behind during a bulk material transfer.

Suitable flexible or rigid, and transparent or non-transparent conveyance units are preferably made of a synthetic material. Examples of suitable materials for conveyance units are polyolefins such as polypropylene, and in particular, polyethylene, polystyrol, styrol copolymers such as SAN, ABS and ASA, polyphenyl ether, PVC, polymethylmethacrylate and polycarbonate, including impact modified variants and any mixtures of these. Naturally, multiple-layer film systems, such as two-, three- or five-layer film systems, can also be used. These could be polyethylene, polypropylene, polyester, in particular polyethylene terephthalate, and polyamide, for example. In order to achieve gas impermeability in particular, e.g. impermeability against oxygen, at least one metallic film, in particular an aluminum film, can be incorporated into multiple layer film systems.

According to a particularly preferred embodiment of the multiple coupling lock according to the preferred embodiment, at least one, in particular a first, or outer, coupling lock is used for the essentially environmentally sealed, reversible closure and for the essentially environmentally sealed filling and/or refilling of bulk materials, which is made in particular of flexible containers or hose elements, and which comprises a first, flexible band with at least one, in particular continuous, locking element, in particular a spring, on its inner side and at least one flexible band with at least one second, in particular continuous, locking element on its inner side, which is complementary to the first locking element, and which enables reversible, tight closure with this, in particular a groove, the first and second band and/or the first and second locking element being in particular essentially of the same length, the first and second band, in particular via each of their end sections, being connected with each other, in particular forming a closed circumference, and the upper side of the first band having at least a third, in particular continuous, locking element and/or the upper side of the second band having at least a fourth, particularly continuous, locking element (also referred to as the first embodiment of the coupling lock), or which uses at least one, in particular first, or outer, coupling element for the essentially environmentally sealed, reversible closure of, and/or for the essentially environmentally sealed filling and/or refilling of bulk materials from in particular flexible containers, hoses or hose elements, comprising in particular essentially rigid frame bands and join elements, those frame bands which are positioned immediately adjacent to each other being connected with each other in each case via at least one join element, forming an enclosing folding frame so that the inner sides of adjacent and/or opposite frame bands can be folded onto each other to form a lock which is in particular environmentally sealed (also known as the second embodiment of the coupling lock).

Here, it has been shown to be particularly advantageous to use the coupling lock as the first, or outer, coupling lock, e.g. in the form of a so-called parallelogram coupling lock, since this makes it possible to create a very large opening profile without any particular force being required, through which the second coupling lock of the multiple coupling lock can then be guided.

Among the adjacent coupling locks of the multiple coupling lock according to the preferred embodiment, the second, or inner, coupling lock preferably comprises one or more sealing flaps or slides, which can be rotated or slid, which are positioned in an essentially rigid pipe socket. In contrast, the first, or outer, coupling locks preferably comprise a locking system with movable or flexible frame or locking bands, so that a tight lock is regularly produced, not by a sealing flap or sealing slide, but by the relative movements of frame or locking bands.

For example, a coupling lock according to the first or second embodiment can be part of a plastic sack, in particular a conveyance unit, and be positioned in the area of the enclosing opening edge of said sack. Here, the second band preferably connects directly with the end of the first band, the two remaining ends or end sections of the first and second band also being directly connected with each other. When not only the inner sides of the first and second band comprise locking elements which correspond with each other, but their upper sides are also fitted with locking elements, which enable the environmentally sealed coupling to a further, i.e. corresponding coupling lock according to the first embodiment, which is part of a second multiple coupling lock to be coupled, e.g. as the first, or outer, coupling lock, the environmentally sealed filling and/or refilling of bulk materials can be assured, even with very flexible sacks and/or band materials.

A preferred coupling lock according to the first embodiment also comprises a locking lid, containing at least a seventh and/or eighth locking element which is/are complementary to the third and/or fourth locking elements of the upper sides of the first and second band, it being possible to connect the seventh and eighth locking elements to the third and/or fourth locking elements to form a temporary cover for the connection slit of the first and second band, when the inner sides of the first and second band are connected with each other via a reciprocal reaction between the first and the second locking element.

Particularly when bulk materials are to be transported or stored over a longer period of time, it has been shown to be advantageous when the connection slit of the first and second bands, which are positioned one on top of the other, is environmentally sealed or covered. This prevents the upper sides of the coupling lock according to the first embodiment from being contaminated by dust or other particles.

In an expedient further development, the coupling lock according to the first embodiment also comprises at least a fifth and/or a sixth locking element on at least one outer side of the first and/or the second band. These fifth and sixth locking elements on the outer side of a band can be used in order to create a temporary connection with a locking lid when two coupling locks according to the first embodiment are being docked, said lid having corresponding seventh and eighth locking elements.

Here, it has been shown to be advantageous if the locking lid is connected with the first or second band, in particular as a single piece, and in particular using at least one film hinge.

In order to simplify the handling of the coupling locks according to the first embodiment, and in order to secure their reliability, it is advantageous if the locking lid comprises at least one operating handle.

In this regard, it is equally advantageous if the first and/or the second band comprises/comprise at least one operating handle, in particular on the outer side.

The coupling lock according to the first embodiment is particularly suitable for filling and/or refilling bulk materials from flexible containers, e.g. plastic bags or sacks, as well as for transferring bulk materials via a connected conveyance unit. Accordingly, in an embodiment, a coupling lock of this type already comprises a flexible bag, hose or in particular, conveyance unit, the opening edge of which is connected with the first and second band either separately or as a single piece. As a result, the coupling lock can be both an integral component of a flexible bag, in particular a conveyance unit, in particular in the area around the edge of the opening of said bag or conveyance unit, or it can be irreversibly connected.

The coupling lock according to the first embodiment is preferably the first, or outer, coupling lock of the multiple coupling lock according to the preferred embodiment. In this function, the coupling lock according to the first embodiment is preferably connected to a conveyance unit which stretches to the second, or inner, coupling lock of the multiple coupling lock. However, if the coupling lock according to the first embodiment is the second, or inner, coupling lock of the multiple coupling lock according to the preferred embodiment, this can, in addition to being connected to the aforementioned conveyance unit, be connected to a container, packing drum, bag or further conveyance unit.

The danger of contamination can preferably also be reduced if at least the inner side and/or the upper side of the first and/or the second band comprises/comprise a bonding and/or adhesive layer, at least in some sections.

The coupling lock according to the second embodiment is also preferably used as the first, or outer, coupling lock of the multiple coupling lock according to the preferred embodiment. Naturally, this coupling lock can also be used as the second, or inner, coupling lock of the multiple coupling lock according to the preferred embodiment.

The coupling lock according to the second embodiment can also advantageously be designed in such a way that the folding frame comprises x frame bands and x joining elements, whereby in particular, x=2 n, and n is a natural number higher than or the same as 2. Naturally, folding frames with five frame bands and five join elements, for example, also fulfill the required purpose.

Coupling locks according to the second embodiment, the folding frames of which are composed of four frame bands and four join elements to form a so-called parallelogram lock, have been shown to be particularly advantageous.

Coupling locks according to the second embodiment, the folding frames of which comprise six or eight frame bands and preferably six or eight join elements, have also been shown to be particularly advantageous.

Coupling locks according to the second embodiment are highly preferable when their folding frames comprise six frame bands and six join elements, with a first pair of adjacent frame bands which are connected via a join element and which are in particular essentially of the same length, together with a second pair of adjacent frame bands which are connected via a join element and which are in particular essentially of the same length, and with a third pair of non-adjacent frame bands and/or which are not directly connected via a join element, in particular essentially of the same length, the total of the length of one frame band from the first pair and the length of one frame band from the second pair not being higher than the length of one frame band from the third pair of frame bands.

Here, those embodiments are of particular advantage where the inner side of the first frame band of the first pair and the inner side of the first frame band of the second pair can both be turned towards the inner side of the first frame band of the third pair, and the inner side of the second frame band of the first pair and the inner side of the second frame band of the second pair can both be turned towards the inner side of the second frame band of the third pair to form a sealed locking slit.

A particularly tight seal can be achieved in particular when the folding frame comprises a sealing lip in the area of at least one of its surrounding edges, which essentially encompasses it, and which extends inwards and/or over the edge.

Coupling locks according to the first embodiment are furthermore characterized by at least one spacer on the outer side of the first and/or the second frame band of the first and/or the second pair of frame bands, which are positioned closer to the shared joining element(s) with the frame band(s) of the third pair of frame bands than to the joining element(s) which connect the frame bands of the same pair of frame bands.

As a result of these spacers, the outer sides of the frame bands of the first and/or the second pair, which are opposite each other in a closed state, are set at a further distance from each other in the area of the joining connections to the frame bands of the third pair, e.g. within a range of 0.5 to 5 mm, than with the joining element which connects the frame bands of a shared pair. This guarantees an even more tightly sealed locking slit.

When adjacent frame bands are connected with each other via a joining element, the inner sides of said frame bands can fold on top of each other to form a locking slit.

The degree of movement and affixation of adjacent frame bands is created, for example, by joining elements in the form of hinges, film hinges and/or elastic materials. Here, the use of film hinges has been shown to be particularly advantageous. These can, for example, connect adjacent frame bands over their entire length, in particular in an environmentally sealed manner. Film hinges of this type can be produced from a rubber-elastic material such as a thermoplastic elastomer, preferably using the dual component injection molding technique. This creates a single-piece folding frame or single-piece coupling lock according to the second embodiment, which is also completely environmentally sealed in the area of the junctions between the frame bands and the joining element or film hinge.

Furthermore, folding frames of this type are preferably used in which the frame bands and the joining elements which connect said frame bands are made of the same material, the strength or thickness of the material in the area of the joining elements being made thin enough to be able to guarantee non-damaging, reversible movement. The strength or thickness of the material in the area of the frame bands, however, is set so as to create essentially rigid frame bands. Suitable materials preferably comprise synthetic materials such as polyamide, polyoxylalkylene, in particular polyoxymethylene (POM), PVC, polyketone, in particular aliphatic, alternating polyketone, its impact-modified variants, and any mixtures of the aforementioned synthetic materials. Folding frames for which the frame bands and joining elements are made of the same material are preferably produced as single pieces.

Particularly tight environmental sealing can also be achieved when the inner sides of the frame bands comprise first and second locking rails for environmentally sealed locking, at least in sections, which are in particular complementary and/or made of elastomer or springy elastic material, the total length of the first locking rail essentially corresponding to the total length of the second locking rail, and the first and second locking rails or their sections being arranged on the inner sides of the frame bands in such a manner that they form an environmentally sealed locking slit when the frame bands are folded one on top of the other, in particular interlocking in such a manner that they are aligned with each other. As a result, the first and second locking rails can have identical forms in an embodiment.

Preferably, locking rails which complement each other are formed and arranged in such a manner that they easily and automatically interlock when the folding frame is folded together.

Here, it is an advantage when the first and/or the second locking rails also extend to the inner sides of the joining elements and/or are positioned on these, or can be attached to them.

Here, it can be provided that the first locking rail is a groove and the second locking rail is a spring which is complementary to the groove. Naturally, a locking rail can also comprise and groove/spring combination.

When film hinges in particular are used, which are incorporated into the coupling lock according to the second embodiment using the dual component injection molding technique, locking rail sections, in particular elastomer sections, can also already be fitted to the inner side of these film hinges during production. Naturally, two or more locking rails can also be attached or positioned together, for example in parallel, on the inner side of frame bands and film hinges, which further increases the tightness of the environmental sealing. Coupling locks according to the second embodiment which are designed in this way necessarily create a very tightly environmentally sealed locking slit simply as a result of the type of handling used when closing said embodiment.

Accordingly, it can be provided, for example, that at least one first locking rail is positioned at least in sections on the inner side of adjacent first and second frame bands, and at least a second locking rail is positioned at least in sections on the inner sides of adjacent third and fourth frame bands.

In principle, the corresponding locking rails can be attached arbitrarily, however, it has been shown to be advantageous when a second locking rail, which is complementary to the first locking rail, and is of the same length, is connected to a first locking rail, the two locking rails extending over the entire circumference of the folding frame. Naturally, the first and second locking rails can also be distributed in seconds over the inner circumference of the folding frame as long as it can be guaranteed that the complementary sections will interlock when closing.

Alternatively, or in addition to, the locking rails described above, the folding frame can comprise a preferably encompassing sealing lip in the area of its surrounding edge or its surrounding border. This sealing lip preferably fulfils at least a double function. In one embodiment, it is thus attached on, above and/or in the area of the edges of the frame bands which form the folding frame so that it essentially surrounds the frame, and extends at least slightly towards the interior of the opening area which is created by the folding frame. If the inner sides of the adjacent or opposite frame bands of the folding frame are then guided or placed away from each other, the sealing lips which point inwards at least partially touch each other or are pressed against each other, and form a sealed locking slit. In a second embodiment, the preferably encompassing sealing lip extends at least slightly over the edge of the folding frame and/or rests on said edge. This ensures that when two coupling locks according to the second embodiment are coupled with each other, the sealing lips of which preferably both extend over the edge and/or are resting on said edge, an environmentally sealed docking device is created. This makes it possible to ensure that when the sealing lip of a coupling lock according to the second embodiment is pressed onto the folding frame or sealing lip of the corresponding coupling lock according to the second embodiment, that they touch to form a seal, at least temporarily. Synthetic or natural rubber, or thermoplastic elastomers are preferably used as material for the sealing lip.

The handling of the coupling lock according to the second embodiment can be further improved by at least two operating handles which can be attached or which are positioned on non-adjacent frame bands in particular.

Furthermore, it can be provided that at least one of the folding frames is made of a single piece.

The coupling locks according to the second embodiment are further characterized by the fact that at least one, in particular all frame bands on the upper side comprise at least one locking element, which is in particular made of elastomer or springy elastic material, at least in sections.

Here it can be provided that the first locking element is a groove and/or a spring which is in particular continuous.

When the upper sides of the frame bands are fitted at least in sections with a locking element, care is taken that two coupling locks according to the second embodiment can be connected with each other in a particularly environmentally sealed manner to form a docking device.

Handling safety can be further increased when the coupling lock according to the second embodiment comprises at least one second locking element on the outer side of at least one frame band, or an extension of said band. This can be an outlet, for example, or a projection, a groove or a spring. Second locking elements of this type can also be used in order to clamp a locking lid particularly securely.

Accordingly, a coupling lock according to the second embodiment comprises at least one locking lid with at least a third locking element, which is essentially complementary to the locking element and/or at least a fourth locking element which is essentially complementary to the second locking element, so that the locking lid covers the locking slit of the folding frame, at least in sections, when the coupling lock is closed.

Here, it can be provided that the locking lid is connected, at least in sections, with a frame band via a hinge, a film hinge or a flexible connecting element.

The handling and transportation of this coupling lock according to the second embodiment can be improved by fitting the locking lid with at least one operating and/or transportation handle.

Coupling locks according to the second embodiment can furthermore comprise a flexible container or a flexible hose or a flexible hose element, which is connected in a sealed manner with the frame bands and/or the join elements.

Naturally, these coupling locks according to the second embodiment can be connected both reversibly and irreversibly with a hose or a flexible bag.

To reduce the degree of contamination when filling or refilling bulk materials, it can further be provided that at least the inner side and/or the upper side of at least one frame band comprise a bonding and/or adhesive layer, at least in sections.

A particularly preferred coupling lock according to the second embodiment is furthermore characterized by at least one first clamping element on the inner side of at least one frame band, and at least one first clamping opening or first latching element in one inner side of at least one frame band, it being possible to latch the first clamping element into the first clamping opening, in particular in a reversible manner, when the folding frame is closed.

The use of clamping pins, for example, on the inner sides of the frame bands, which are arranged in such a manner that they can latch into corresponding clamping openings or latching elements, ensures that once a lock has been attained, it cannot be released again without the application of external force. In addition, this inner latching mechanism, depending on the measurement of the length of the clamping element, causes the complementary locking rails which are positioned on the inner sides of the frame bands are pressed against each other, which contributes to the formation of particularly secure environmental sealing. Below the clamping openings, for example, it should be imagined that both openings which penetrate through the wall of the frame bands, and openings, i.e. concavities or indentations in the inner wall of the frame bands, are positioned, which do not lead to an opening. As a result, there is no loss of environmental sealing caused by a clamping technique of this nature. Naturally, the clamping elements or pins can be formed in such a way, when clamping holes are used, that they keep the holes completely closed in an environmentally sealed manner as soon as they latch into said holes. For example, with a parallelogram lock, several clamping pins can be positioned on two adjacent sides, and the remaining two sides being fitting with corresponding clamping concavities or latching elements. These clamping pins or openings or concavities and latching elements must be attached in such a manner that they interlock essentially with a precise fit when the frame bands are folded one on top of the other.

Furthermore, the coupling locks according to the second embodiment are also characterized by at least one handle on the outer side of at least two, in particular opposite, frame bands, in particular in the area of or below the junction between the outer side and the upper side of a frame band.

Here, it is of particular advantage when the handle comprises at least one handle bar attached to the outer side of a frame band, containing at least one second clamping opening, at least one first handle element, in particular a first handle plate, at least one second handle element, in particular at least a second handle plate, and at least one first and at least one second film hinge, the first handle element being connected with the handle bar via the first film hinge, and the second handle element being connected with the first handle element via the second film hinge, and the second handle element, in particular in area around the edge, having at least one second clamping element, which corresponds to the second clamping opening, and it being possible to fold the second handle element onto the first handle element, and to latch the second clamping element into the second clamping opening, in particular in a reversible manner.

According to a further embodiment, it is suggested that with at least one joint, in particular with two opposite or not directly adjacent joints, adjacent frame bands and/or their extension in the joint form, at least in sections, an angle, at least in the profile in the joint, in particular an acute or right angle.

Here, it can be provided that at least one notch, in particular one which is essentially parallel to the rotational axis of the joint, is positioned at least along a section of the inner side of at least one joint, in particular on the inner sides of opposite joints. A notch according to the basic principle of the present preferred embodiment should be imagined as a constructive technique which makes it possible to place adjacent frame bands which emerge from this joint one on top of the other, without any opening remaining in the area of the joint. Due to the notch, the joint functions as a folding hinge with an essentially closely localized, fixed rotation point at the turning point of the notch. In this way, not only the inner sides of the frame bands which are folded one on top of the other are in alignment with each other, but also the sections of the joint which extend these frame bands up to the actual centre of rotation, and which meet in this center of rotation.

The coupling locks according to the second embodiment can for example be attained when the coupling lock is produced by injection molding, in particular using the dual component injection molding technique, a rubber elastic material or a thermoplastic elastomer being used for the joint elements and a thermoplastic and/or a duroplastic material being used for the frame bands.

Here, it can be provided that this procedure be conducted using a single injection mold form, in particular in a single stage, or with at least two injection mold forms, in particular in two or more stages.

It is furthermore suggested that the joint or joints are injection-molded onto adjacent frame bands, or that one or more frame bands are injection-molded onto adjacent joints.

According to an alternative method of production, the frame bands can also be connected to the joints using adhesive or welding techniques. It has been shown to be particularly advantageous to connect frame bands and joints with each other using injection molding. Suitable adhesive agents, and welding and injection molding techniques, will be known to persons having the ordinary skill in the art.

According to a further embodiment, the coupling lock of the multiple coupling lock according to the preferred embodiment, in particular the second, or inner, coupling lock, comprises a closing flap with a first pipe connection, it being possible to bring the closing flap to a closed position, in which the first end of the pipe connection can be locked in a particularly atmospherically sealed manner—which is also known as the coupling lock according to the third embodiment. Systems of this type are disclosed, for example, in DE 695 04 581 T2.

According to DE 200 14 871 U1, for example, suitable coupling locks according to the third embodiment are also present in devices for coupling two storage units and/or conveyance units, such as receptacles, containers, pipes and/or similar for the purpose of transferring a product from one first means of storage and/or conveyance unit with a first closing flap in a first pipe connection at a first end into a second storage unit and/or conveyance unit with a second closing flap in a second pipe connection at a second end, using a rotating device and a securing device, with which the closing flaps in a closed position, in which the first closing flap locks the first storage unit and/or unit conveyance at a first end in a particularly atmospherically sealed manner, and the second closing flap locks the second unit of the storage and/or of conveyance unit at a second end in an atmospherically sealed manner, and the two closing flaps and/or the two pipe connections can be moved relative to each other into a locking position in which the two closing flaps and/or the two pipe connections are firmly connected to each other, and into an open position with closing flaps and/or pipe connections which are firmly connected to each other, in which at least one through-flow opening from the first storage unit and/or conveyance unit opens for the product into the second storage unit and/or conveyance unit, and can be moved from the open position into the locking position, and into the closed position, an actuation device in particular being provided, via which the securing device for changing from the closed position into the locking position, in which the two storage units and/or conveyance units are sealed against each other, and then the rotation device for moving into and then moving out of the open position, followed by the securing device for changing from the locking position to the closed position, can be driven.

Furthermore, suitable coupling locks according to the third embodiment, for example according to DE 200 14 872 U1, are also present in devices for coupling two storage units and/or conveyance units, such as receptacles, containers, pipes and/or similar for the purpose of transferring a product from one first storage unit and/or conveyance unit with a first closing flap in a first pipe connection at a first end and in interaction with at least one shaft into a second storage unit and/or conveyance unit with a second closing flap in a second pipe connection at a second end and in interaction with at least one shaft, in which the first closing flap locks the first storage unit and/or conveyance unit at a first end in an atmospherically sealed manner, and the second closing flap locks the second storage unit and/or conveyance unit at a second end in an atmospherically sealed manner, and the two closing flaps and/or the two pipe connections can be moved relative to each other into a cleaning position, in which the two closing flaps and/or the two pipe connections are set at a distance from each other under the limitation of a cleaning area which can be connected with a cleaning device, and following the actuation of at least one shaft into an open position in which the closing flaps are placed on top of the other, and in which at least one through-flow opening is open for the product from the first storage unit and/or conveyance into the second storage unit and/or conveyance unit, and can be moved from the open position into the cleaning position following the actuation of at least one shaft, and into the closed position, characterized in particular by a first, essentially ring-shaped seal between the first closing flap and the first pipe connection, a second, essentially ring-shaped seal between the second closing flap and the second pipe connection, a third, essentially ring-shaped seal between the first pipe connection and the second pipe connection, and a fourth, essentially ring-shaped seal between the second pipe connection and a second shaft section, which cooperates with at least one shaft, and which is firmly connected to the second closing flap, the first, second, third and fourth seals sealing the cleaning area both against the atmosphere and against the product.

Furthermore, it can thus be provided that the second coupling lock comprises a closing flap with a first pipe connection, it being possible to bring the closing flap into a closed position, in which the first end of the pipe connection can be sealed tightly against the atmosphere.

The coupling locks according to the third embodiment described below are particularly suitable as second, or inner, coupling locks of the multiple coupling lock according to the preferred embodiment. A coupling lock of this type can be designed as an active or passive lock. Active and passive locks according to the third embodiment each comprise pipe connections, in which flaps or valves are mounted in such a way that they can be rotated. Only the flap or the valve of the active coupling lock can, preferably using a gear device, be actively actuated, in order to be transferred to an open or a closed position. The valve of both the active and the passive lock generally comprises a closing flap with a closing area and an encompassing closing flap seal, with which the closing flap is sealed against the pipe connection in the locking position. Furthermore, the valve generally comprises an enclosing flap seal, which is made to touch the corresponding coupling lock to create a seal while coupling. When active and passive coupling locks are coupled with each other, the passive closing flap can also be transferred from a locking into an open position and vice-versa, depending on its placement on or connection to the active closing flap, by actuating the flap. Naturally, it is also possible to couple two of the previously mentioned active coupling locks with each other. In an exemplary embodiment, a multiple coupling lock according to the preferred embodiment comprises as the first, or outer, coupling lock a coupling lock according to the first or second embodiments, and as the second, or inner, coupling lock a coupling lock according to the third embodiment. When in a coupled state, corresponding coupling locks according to the third embodiment, in particular in the form of an active and passive lock, form a docking device according to the third embodiment, and following the basic principle of the preferred embodiment.

Furthermore, a coupling element for the environmentally sealed filling and/or emptying of containers, such as that described in WO 03/037717 A1, can be used, which is or can be connected either in a fixed or detachable manner with an essentially flexible container, at least in sections, and in an essentially environmentally sealed manner on a first side, in particular the underside, it being possible to elastically reform the coupling element, at least in sections, and the coupling element having a second side, in particular an upper side, which can be docked in an essentially sealed and in particular reversible manner to a second side, in particular an upper side, of a second coupling element, said coupling element being closed in its basic state, and it being possible to reversibly open it when elastically re-formed, in particular via at least one slit, so that a passage is created from the first to the second side of the coupling element (also known as the coupling lock according to the fourth embodiment). When in a coupled state, corresponding coupling locks according to the fourth embodiment form a docking device according to the fourth embodiment, and following a principle of the preferred embodiment.

In general, therefore, such locks as those known from DE 195 20 409 C1, DE 43 42 962 C1, WO 02/18248 and WO 02/18247 can also be used as the first, or outer, coupling locks for the multiple coupling lock according to the preferred embodiment. In addition, systems can also be considered for use as suitable coupling locks such as those described in WO 03/037756, WO 03/037717 and the unpublished German patent application with the file reference number 103 21 814.9.

According to a further aspect of the multiple coupling locks according to the preferred embodiment, these can also comprise at least one conveyance unit, which connects adjacent first, or outer, and second, or inner, coupling locks with each other, and which is essentially rigid, while at the same time being transparent in particular. Conveyance units, or hoses, of this type are suitable for use in cases when a coupling lock of a second multiple coupling lock, which corresponds to the second coupling lock affixed to the rigid conveyance unit, is guided through the opening of the first, or outer, coupling lock of the first multiple coupling lock into the conveyance unit, and can be docked onto the essentially invariantly movable second, or inner, coupling lock. In accordance with the basic principle of the present invention, a rigid conveyance unit should not be understood to be simply one which cannot be changed in terms of the expansion of its length or breadth, but also one which permits a certain degree of relative movement by the adjacent first and second coupling lock, while not, however, permitting the second, or inner, coupling lock, even in sections, to be guided into or through the opening of the first coupling lock.

According to a further embodiment, the multiple coupling lock according to the preferred embodiment comprises at least one, in particular reversible and/or environmentally sealed connection unit, in particular a triclamp connection, on at least one coupling lock or a basic body, conveyance unit or container, which is connected to a coupling lock, with which the first or second conveyance unit can be or is connected, either indirectly or directly, in particular in an environmentally sealed manner, with a coupling lock or the basic body or container which is connected to the coupling lock.

The connection unit can comprise, for example, mechanical connections such as clip or latch connections, flanges, triclamp connections, ANSI flanges and DIN flanges, and adhered or welded connections. These connection units, in particular the triclamp connection, regularly form a fixed connection on the coupling lock or the basic body, container or conveyance unit which is connected to this coupling lock, and in particular encompass them. As a result, the conveyance unit which connects adjacent coupling locks can be tightly sealed on one side, or on one of its openings, with the coupling lock, its basic body, container or other conveyance unit, via the connection unit. Alternatively, or in addition, it is also possible to tightly seal the conveyance unit or an opening in the conveyance unit using adhesion and/or welding with the coupling lock, its basic body, a connected container or a means of conveyance.

It has been shown to be particularly advantageous when the conveyance unit can be or is attached reversibly to at least the second, or inner, coupling lock, so that a system from the first, or outer, coupling lock and the attached conveyance unit, for example, can be attached to a second coupling lock, or to a basic body or container connected to this coupling lock, according to requirements and to the purpose of use. In this manner, the degree of freedom of contamination can be set according to requirements, which permits highly flexible handling. The so-called triclamp connections can be considered for reversibly connecting conveyance unit or hoses. These are known to persons having the ordinary skill in the art, and are available on the market.

Naturally, it is also possible in an embodiment that the first and/or the second conveyance unit comprises, for example, a coupling lock according to the first or second embodiment, and that the connection unit comprises a coupling lock which corresponds with this, so that an environmentally sealed connection can be achieved between the conveyance unit and the coupling lock, the basic body or the connected container of which form a docking device, comprising a first and a second, or corresponding, coupling lock according to the first embodiment, the first and second band of the first coupling lock and the first and second band of the second coupling lock in particular being essentially of the same length, and the third and fourth locking elements on the upper sides of the first and second band of the first coupling lock each being complementary to the third and fourth locking elements on the upper sides of the first and second band of the second coupling lock, so that the first and second bands of the first and second coupling lock can be connected with each other reversibly and in particular in an environmentally sealed manner (also known as the first embodiment of the docking device), or a docking device for the particularly environmentally sealed filling and/or refilling of bulk materials, comprising a first and a second coupling lock according to the second embodiment the first and the second coupling locks being essentially the same in terms of their number, length and the arrangement of their frame bands, resulting in first and second folding frames which can be connected with each other, and whereby in particular the first locking element on the upper side of the frame bands of the first coupling lock is complementary to the first locking element on the upper side of the bands of the second coupling lock, so that the first and second coupling locks can be connected with each other in a reversible, and in particular an environmentally sealed manner (also known as the second embodiment of a docking device).

An object of the preferred embodiment is furthermore attained by a multiple docking device, in particular a double docking device, in particular for the environmentally sealed filling and/or refilling of bulk materials, comprising a first and a second multiple coupling lock according to the preferred embodiment, it being possible to couple the first, or outer, coupling locks of the first and second multiple coupling lock with each other to form a first, in particular environmentally sealed, docking device, and whereby the adjacent second, or inner, coupling locks from the first and second multiple docking device can be coupled with each other to form a second docking device. Advantageous multiple docking devices according to the preferred embodiment accordingly comprise in each case corresponding first, or outer, and second, or inner, pairs of coupling locks, which can simultaneously be coupled next to each other in the form of docking devices. Here, the actual transfer of bulk materials is made via the open second docking device, i.e. the docking device formed in each case from the second, or inner, coupling locks. The conveyance unit or hoses which are connected with each other in each case via the first, or outer, coupling locks, form a protective mantle, which hermetically shields the second, or inner, docking device from the external environment, at least during the refilling procedure.

A further development of the multiple docking device according to the preferred embodiment can also comprise a multiple coupling lock according to the preferred embodiment and a coupling lock, which can be coupled to the second, or inner, coupling lock of the multiple coupling lock to form a first or second embodiment of a docking device, which is in particular environmentally sealed, and on which or on the basic body of which, or on the container or conveyance unit connected with the coupling lock, a connection unit is fitted, which can be docked to the first, or outer, coupling lock of the multiple coupling lock, in particular in an environmentally sealed manner.

In contrast to the embodiment described above, it is therefore only possible for one multiple coupling lock according to the preferred embodiment to also be a component of a multiple docking device when a coupling lock is also present which can be coupled to the second, or inner, coupling lock of the multiple coupling lock, i.e. with the lock with the smaller opening area. This coupling lock, as opposed to the multiple coupling lock according to the preferred embodiment, does not have an conveyance unit which connects adjacent first and second coupling locks. It is far more the case that a further coupling unit or coupling lock is attached to this coupling lock, to its basic body, or to the receptacle or container connected with this coupling lock or the basic body, which is suitable for forming a docking device with the first, or outer, coupling lock of the multiple coupling lock. In this way, for example, a parallelogram lock, or coupling lock according to the second embodiment, or a connection unit, e.g. in the form of a triclamp connection or coupling, can be attached in an environmentally sealed manner to the basic body of the previously mentioned coupling lock, which can be connected with a corresponding first parallelogram coupling lock, or a coupling lock according A to the second embodiment of the multiple coupling lock in a reversible a manner. In contrast to the variation of a multiple docking device according to the preferred embodiment first mentioned, it is not possible with this variant to separate the first coupling lock of the multiple coupling lock from the connection unit when in a closed state.

Accordingly, it can further be provided that the first, or outer, coupling locks from the first and second multiple coupling lock, together with the connection unit, form a docking device according to the first or second embodiment.

Multiple docking devices according to the preferred embodiment are characterized in a further embodiment by the fact that the second, or inner, coupling locks from the first and second multiple coupling lock create a unit for coupling two storage units and/or conveyance units for the purpose of transferring bulk materials from a first storage unit and/or conveyance unit with a closing flap in a first pipe connection at a first end and in interaction with at least one shaft into a second storage unit and/or conveyance unit with a second closing flap in a second pipe connection at a second end and in interaction with at least one shaft, whereby the closing flap from a closed position, in which the first closing flap locks the first storage unit and/or conveyance unit at a first end in particular in an atmospherically sealed manner, the second flap locks the second storage unit and/or conveyance unit in an atmospherically sealed manner, and the two closing flaps and/or the two pipe connections can be moved relative to each other.

Furthermore, multiple docking devices according to the preferred embodiment can also comprise at least one suction device and/or at least one rinsing device in interaction with the first or second docking device and/or at least one conveyance unit.

An object of the preferred embodiment is also a container, in particular a flexible container, which comprises a multiple coupling lock according to the preferred embodiment, whereby in particular the second, or inner, coupling lock on the outlet opening of the multiple coupling lock can be or is connected directly with the container, or via a flexible hose element, or is an integral component of said container.

The present preferred embodiment also comprises a conveyance unit, in particular a hose, containing at least one multiple coupling lock according to the preferred embodiment, the conveyance unit, in particular an opening edge area of the conveyance unit, being indirectly or directly connected, or connectable, to a second, or inner, coupling lock of the multiple coupling lock.

The two coupling locks to be connected with each other according to the first embodiment essentially have identical dimensions, in order to make environmentally sealed coupling possible. A particular advantage of the docking device according to the first embodiment also consists of the fact that two identical coupling locks according to the first embodiment can be used. For this purpose, it is already sufficient when the third and fourth locking elements of the first and second band of the coupling lock are designed to be complementary to each other. For example, the third locking element on the upper side of the first band can be a spring, and the fourth locking element on the upper side of the second band can be a groove which is complementary to the spring. When the coupling locks to be coupled essentially have identical dimensions or lengths, these can then be connected with each other in an environmentally sealed manner. This significantly reduces manufacturing and storage costs for the docking devices according to the first embodiment.

A preferred embodiment of a docking device according to the first embodiment furthermore comprises at least a fifth and/or sixth locking element on at least one outer side of the first and/or second band of the first and/or second coupling lock, which is or are complementary to the seventh and/or eighth locking elements of the locking lid(s) of the first and/or the second coupling lock. Even when only one coupling lock is fitted with a locking lid, which comprises seventh and/or eighth locking elements, which can latch into fifth and/or sixth locking elements which are attached to a band, the handling safety is significantly increased during the refilling procedure. The corresponding use of a second locking lid, which is positioned on a second coupling lock, achieves even tighter environmental sealing and safety.

Accordingly, it can be provided that the locking lid of the first coupling lock be reversibly connectable or connected with at least a seventh and/or eighth locking element of the second coupling lock, and that the locking lid of the second coupling lock be reversibly connectable or connected with at least a seventh and/or eighth locking element of the first coupling lock, when the third and fourth locking elements from the first and second coupling lock are connected with each other.

According to a further aspect, the aforementioned docking devices according to the first embodiment can already be connected, or connectable, with at least one flexible container, hose or hose element via their first and second coupling locks.

Docking devices according to the second embodiment which follow the basic principle of the present preferred embodiment are composed of two corresponding coupling locks, i.e. coupling locks which can be coupled, according to a second embodiment as disclosed above. In the following, coupling locks in relation to docking devices according to the second embodiment are always coupling locks according to the second embodiment.

Docking devices according to the second embodiment are furthermore characteristic by at least one second locking element on the outer side of at least one frame band of the first and/or the second coupling lock, which is complementary to the fourth locking element of the locking lid.

Docking devices of this type according to the second embodiment comprise, in a further embodiment, a flexible container and/or a hose or hose element, which is essentially connected with the first and/or second coupling lock in an environmentally sealed manner.

Furthermore, for a particularly tight environmental seal when removing samples, flexible containers can also be included, with at least one removal device, in particular in the form of a spoon or spatula, which is connected with the flexible container on the inner side.

Of particular advantage with the second embodiment of a coupling lock described above is that when a folding frame is used, a particularly reliable locking and refilling variant has been found, which is also not prone to error. Simply by moving adjacent frame bands towards each other, locking rails which are complementary to each other can be made to interlock. It is also of particular advantage, particularly with regard to the current art coupling locks or coupling elements, that adjacent frame bands can also be opened wide against each other, thus preventing bulk material residues, e.g. in acute angle niches, from remaining lodged during refilling and subsequently causing contamination of the environment. In addition, there is no necessity to then fit additional suction devices in the area of the join elements.

An object of the preferred embodiment is furthermore attained by a procedure for filling, refilling and/or emptying flexible or rigid containers, in particular in an environmentally sealed manner, whereby a) a first container according to the preferred embodiment, which is connected with the second, or inner, coupling lock of a first multiple coupling lock in an essentially environmentally sealed manner, is connected with a stationary or transportable second container according to the preferred embodiment, which is connected with the second, or inner, coupling lock of a second multiple coupling lock in an essentially environmentally sealed manner, or with a conveyance unit according to the preferred embodiment, which is connected with the second, or inner, coupling lock of a second multiple coupling lock in an essentially environmentally sealed manner, in each case via the first, or outer, coupling lock on the first and second multiple coupling lock according to the preferred embodiment to form a docking device, in particular according to the first or second embodiment, in an open or in particular a closed state b) the docking device is opened from the first, or outer, coupling locks on the first and second multiple coupling lock, while retaining a docking device which is in particular environmentally sealed c) the second, or inner, coupling locks on the first and second multiple coupling locks are connected with each other using the opening of the first docking device and forming a second, in particular environmentally sealed, docking device, in particular according to the third embodiment d) the second, or inner, coupling locks on the first and second multiple coupling lock are opened while retaining a second docking device, in particular an environmentally sealed docking device e) the bulk materials are transferred from the first into the second container, or vice-versa, or through the means of conveyance into the first or second container, or vice-versa f) the second, or inner, coupling locks on the first and second multiple coupling lock are locked, in particular in an environmentally sealed manner, while retaining a docking device, in particular an environmentally sealed docking device g) the second, or inner, coupling locks on the first and second multiple coupling lock are separated from each other when decoupling the second docking device, in particular in an environmentally sealed manner h) the first, or outer, coupling locks on the first and second multiple coupling lock are locked in particular in an environmentally sealed manner, while retaining a docking device, in particular an environmentally sealed docking device, and i) the first, or outer, coupling locks on the first and second multiple coupling lock are separated from each other when decoupling the first docking device, in particular in an environmentally sealed manner Here, it can be provided according to the preferred embodiment that subsequent to stage h), the inner area formed by the first and second conveyance unit, i.e. the conveyance unit from the first and second multiple coupling lock, and from the first docking device, is assigned at least one suction device with a vacuum.

Suitable suction devices are known from DE 195 20 109 C1, for example.

Furthermore, it can be provided that following stage g), the inner area, in each case formed by the first and second conveyance units between the closed first and second coupling locks of the first and second multiple coupling lock, is equipped with at least one suction device with one vacuum.

Finally, the procedure according to the preferred embodiment also comprises embodiments in which following stage h) and/or stage g), the inner area between the second, or inner, coupling locks on the first and second multiple coupling lock and/or the inner areas between the first and second coupling locks on the first and second multiple coupling lock and/or following stage f) and/or stage h), the docking device/devices are rinsed with a cleaning fluid.

Suitable cleaning devices for docking devices, or docking devices with cleaning chambers, are known from WO 02/18247 and WO 02/18248, for example.

Of particular advantage with the embodiment of a multiple coupling lock described below, and with a multiple docking device formed from locks of this type, is that an extremely high degree of contamination safety can be achieved, even with coupling lock systems or docking devices which have a less complex structure. This results in classification as a higher purity class, which also applies to the aforementioned coupling lock systems according to the first and second embodiment. Here, it has been shown to be of particular advantage that even when a coupling lock which locks a container fails, the environment is not contaminated with the bulk materials which are to be refilled. The same protective function can be achieved with an incomplete or malfunctioning cleaning cycle for an interior, second docking device. Furthermore, the multiple component lock is characterized by its very wide range of variations for attaching hose elements. It is also advantageous that the special features mentioned above can be adapted to a wide range of different coupling locks, which are used with the multiple coupling locks according to the invention, as long as it can be guaranteed that in each case, pairs of two coupling locks on two multiple docking devices correspond with each other, and can form an environmentally sealed docking device. When transparent hose elements are selected, for example, which connect the individual coupling locks on a multiple coupling lock or its basic body with each other, a check can already be made from outside during the refilling or cleaning procedure as to whether irregularities or faults have occurred during filling or refilling. In the same way, this embodiment makes it possible to continue the cleaning or suction procedure until the bulk material residues in the inner area formed by the hose elements and coupling locks on corresponding multiple coupling locks are no longer present, or can no longer be detected.

FIG. 1 shows a first embodiment of a coupling lock 1 in a schematic profile view in a closed state. The first band 2 and the second band 4 of the coupling lock 1 touch each other on their inner sides 6 and 8 when the flexible bag 26 is locked. Here, the first locking element 10, which has been designed in the form of a spring, and which is positioned on the inner side 6 of the first band, grips into the second locking element 12, which is designed in the form of a groove, and which is positioned on the inner side 8 of the second band 4. The first and second locking elements 10 and 12 can be designed as desired, as long as they complement each other in terms of their form and size, and ensure that the first and second bands 2 and 4 do not loosen their grip on each other without the application of external force. Suitable clip, groove or rivet locks are known to persons having the ordinary skill in the art. The first and second locking elements 10 and 12 advantageously extend along the entire inner sides of the first and second band 2 and 4. Naturally, it is also possible to provide further first and second locking elements 10 and 12, which are complementary to each other, on the inner sides 6 and 8 of the first and second band 2 and 4. In this way, the tightness of the seal of the coupling lock 1 can be further increased. Furthermore, the upper sides 14 and 16 of the first and second band 2 and 4, comprise third and fourth locking elements 18 and 20. On the outer side 22 of the first band 2, a fifth locking element 24 is attached, which contributes to the further clamping of a docking device formed from two coupling locks 1 and 1' (not shown). The precise method of functioning of this device will be described in greater detail below.

Figure 2:
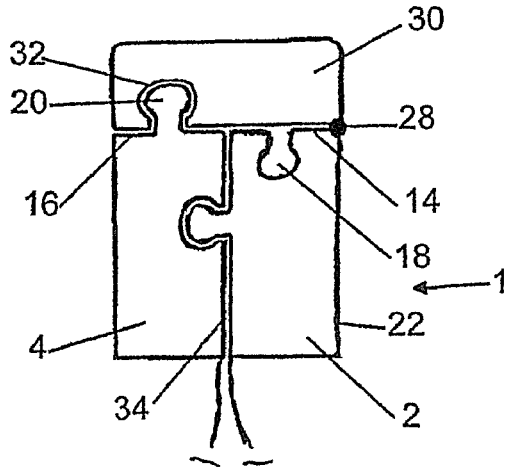
FIG. 2 shows a schematic profile view of an alternative embodiment of a coupling lock.

FIG. 2 shows a schematic profile view of a coupling lock 1 according to the first embodiment, which essentially corresponds to that shown in FIG. 1, the first band 2 of the coupling lock 1 being connected with a locking lid 30 via a joint 28. The joint 28 can for example be a hinge, a sequence of several hinges, a film hinge or other devices. It is advantageous when the joint 28 is located in the area of the junction between the upper side 14 and the outer side 22 of the first band 2. In the locking lid 30, a sixth locking element 32 is incorporated, which is designed in terms of its form, size and position in such a way that when the locking lid 30 is placed over the upper sides 14 and 16 of the first and second band 2 and 4, a clamping interaction with the fourth locking element 20 on the upper side 16 of the second band 4 occurs. A complementary design in terms of form and size has also been shown to be particularly advantageous with regard to the fourth and sixth locking element 20 and 32. In this way, a slit 34 on the coupling lock 1 is not only completely covered, achieving even tighter environmental sealing, but that alongside the interaction between the first and second locking element 10 and 12 on the inner sides 6 and 8, the interaction between the fourth and sixth locking element 20 and 32 contributes to preventing the inner sides 6 and 8 which touch each other from being opened easily. Naturally, it is also possible to provide a further, seventh locking element (not shown) in the locking lid 30, which corresponds with the third locking element 18 on the upper side 14 of the first band 2, and which can form a clamping lock.

Figure 3:
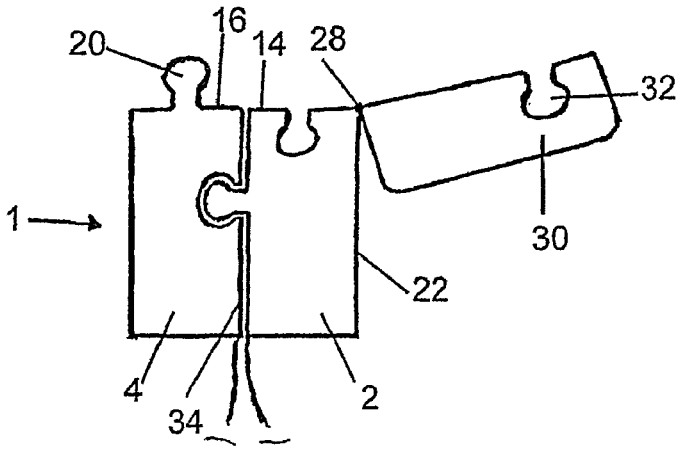
FIG. 3 shows a schematic profile view of a coupling lock according to FIG. 2.
Figure 4:
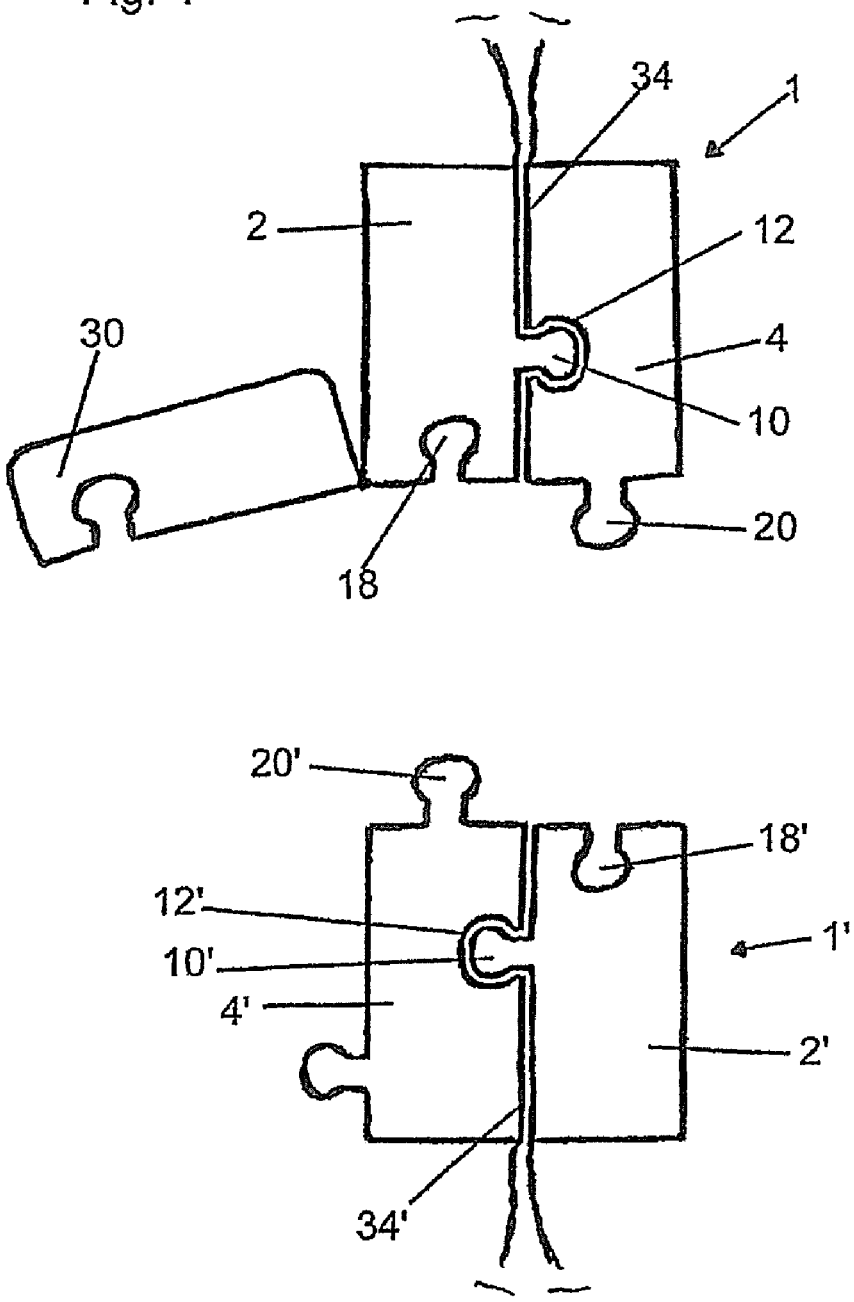
FIG. 4 shows a schematic profile view of two coupling locks.
Figure 5:
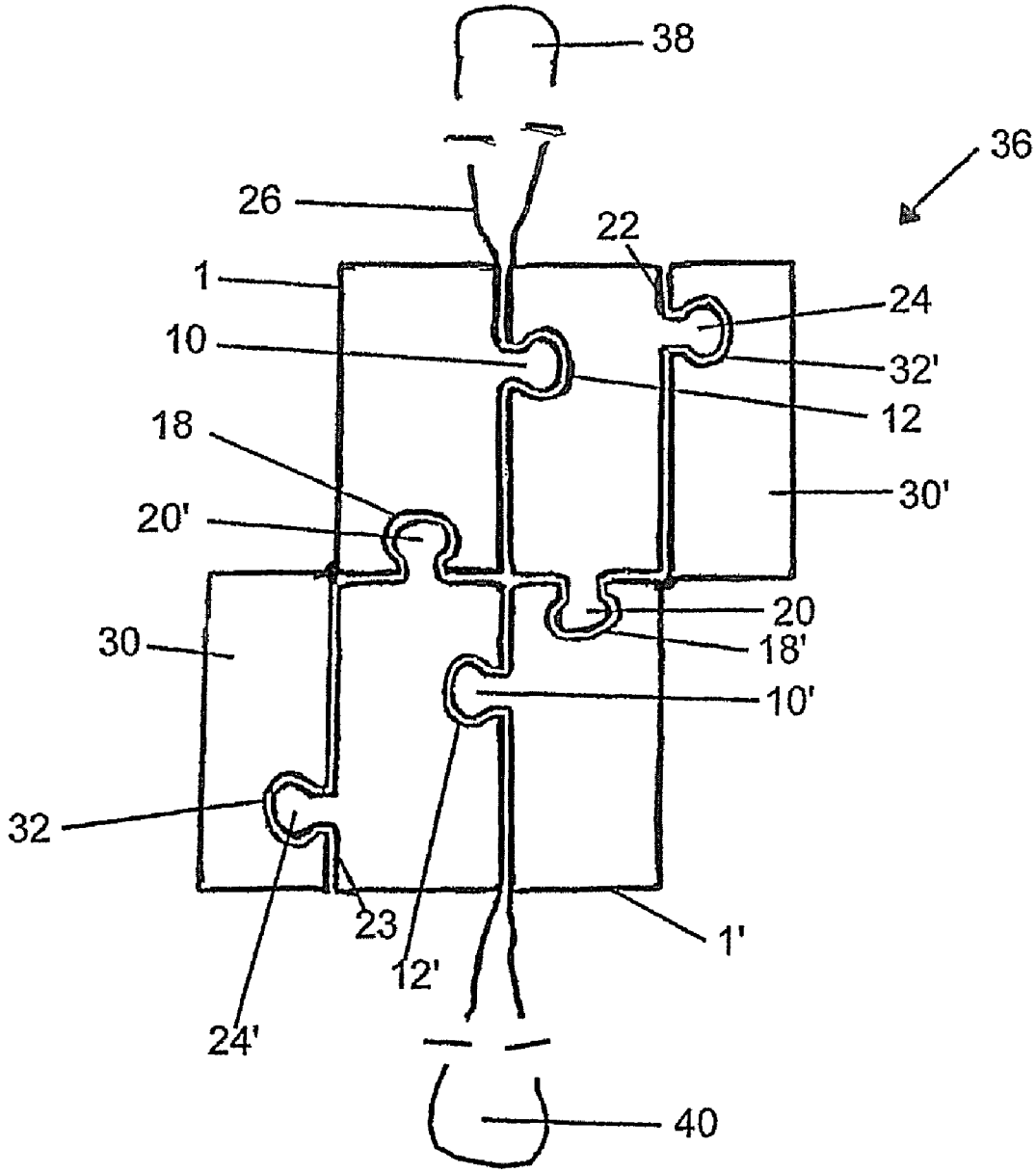
FIG. 5 shows a schematic profile view of a docking device.
Figure 6:
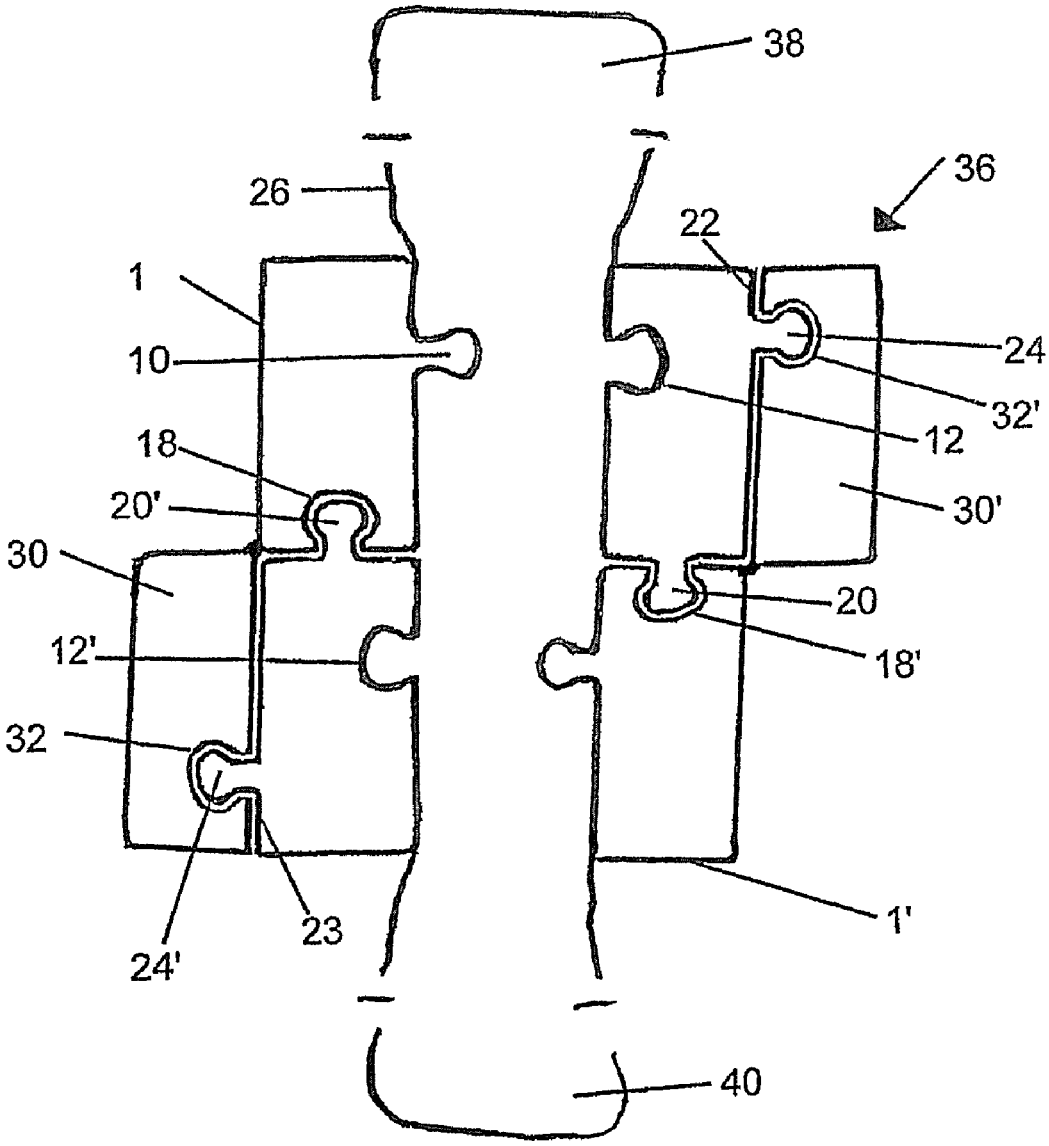
FIG. 6 shows a schematic profile view of a docking device according to FIG. 5.

FIG. 3 shows the embodiment according to FIG. 2 with a folded up locking lid 30. In this state, it is possible, for example, to add a second coupling lock 1' to the first coupling lock 1, as shown in FIG. 4, in order to form a docking device. Here, the third and fourth locking elements 18' and 20' of the second coupling lock 1' must be adjusted to the third and fourth locking elements 18 and 20 of the first coupling lock 1, in order to achieve the desired latching effect. Here, the third locking element 18 of the first band 2 grips into the fourth locking element 20' of the second band 4' of the coupling lock 1'. The same applies to the locking elements on the second and first band 2 and 2' of the first and second coupling lock 1 and 1'. When the slit 34' of the second coupling lock 1' is also kept closed in an environmentally sealed manner by the interaction between the first and second locking element 10' and 12', the first and second coupling locks 1 and 1' can easily be joined with each other to form a docking device 36 as shown in FIG. 5. The coupling locks 1 and 1' on the docking device 36 according to the embodiment shown in FIG. 5 also each have a locking lid 30 and 30', which in both cases can be used to interact with the fifth locking or clamping elements 24 and 24' which are attached to the outer sides 22 and 23 to create a clamping mechanism. In this way, a particularly tight connection between the coupling locks 1 and 1' is created. This furthermore has the advantage that the locking lids 30 and 30' can also be used as handles in order to release the first and second bands on the first and second coupling lock 1 and 1' from each other while retaining an environmentally sealed lock, as shown in FIG. 6. Now, bulk material, such as that present in the flexible container 38 shown, which is connected with the coupling lock 1 via the edge of the bag 26 in an environmentally sealed manner, can be transferred into a second container 40, which is in turn connected with the second coupling lock 1' in an environmentally sealed manner. After the refilling procedure has been completed, the first and second coupling locks 1 and 1' are closed again, and the coupling locks can be separated from each other.

Figure 7:
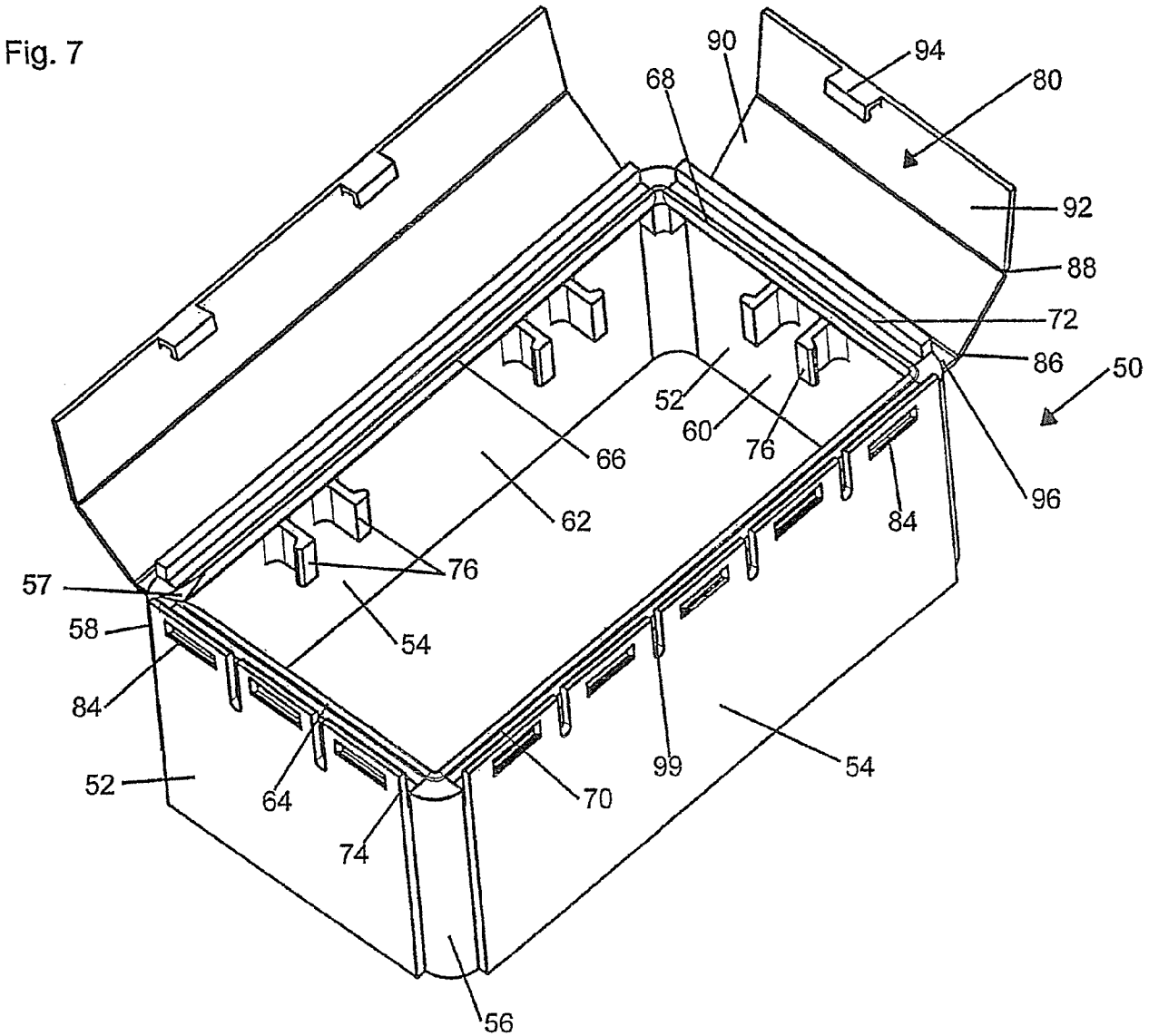
FIG. 7 shows a schematic perspective view of a further, second coupling lock.

FIG. 7 shows a further, second embodiment of a coupling lock 50 in the form of a so-called parallelogram lock. The coupling lock 50 shown is composed in total of two narrow frame bands 52 and two longer frame bands 54, and joint elements 56 in the form of film hinges which connect each of these frame bands. A construction of this type can be produced, for example, using a dual component injection molding procedure, whereby thermoplastic elastomers can be used for the film hinges, and thermoplastic synthetic materials or duroplasts can be used for the frame bands. In a folding frame 58 which is constructed in this manner, the degree of freedom of movement of the individual frame bands 52 and 54 is severely limited. A very large opening profile can also be achieved. When the angle of adjacent frame bands 52 and 54 is reduced or increased, the opening profile can also be varied as desired. This enables the inner sides 60 and 62 of the frame bands 52 and 54 to easily be placed on top of each other to form a lock. A particularly tight environmental seal is achieved when two locking rails 64 and 66 are attached to the inner sides 60 and 62. These rails preferably also extend over the inner sides of the joints 56. The material used here can be a springy-elastic material, for example in the form of bands, which are pressed against each other when the folding frame 58 is folded together. In an advantageous embodiment, the locking rails are made of the same material as the joints 56. In a further embodiment, the first and second locking rails 64 and 66 can also be provided as locking elements with complementary forms, which interlock with each other so that they are aligned and form a seal when the folding frame 58 is folded together. For example, a groove construction can be used for the first locking rail 64 and a corresponding spring rail can be used for the second locking rail 66.

Here also, a particularly tight environmental seal is achieved when the first and second locking rails 64 and 66 also extend over the inner sides of the joint elements 56, which can in particular be folded up.

Insofar as the coupling locks 50 according to the second embodiment are intended for the purpose of forming a docking device according to the second embodiment, it is of great advantage when first locking elements 72 are provided on the upper sides 68 and 70 of the frame bands 52 and 54, which are suitable for gripping into the corresponding locking elements of a second coupling lock 50' according to the second embodiment (not shown), so that they are aligned and environmentally sealed. First locking elements of this type preferably extend over the entire length of the upper side of the frame bands 52 and 54. A particularly tight environmental seal can be achieved by providing a combined groove-and-spring construction for these first locking elements.

In order that a coupling lock 50 remains permanently sealed shut after it has been locked, unless external force is applied or an additional mechanism is used, first clamping elements 76, such as clamping pins or a pair of adjacent clamping elements 76 are provided on the inner sides of adjacent frame bands 52 and 54, which correspond in terms of their form and size with the first clamping openings 78 or clamping latching openings or pairs of these, which are attached to the inner sides of the remaining two frame bands 52 and 54 of the folding frame 58, and which preferably correspond in terms of their form, size and position to the first clamping elements. When the coupling lock 50 is closed, these first clamping elements 76 latch into the clamping openings 78 or rails, so that the lock which is attained cannot be released again without the application of external force. It is advantageous when the position and size of the clamping hooks 76 and the clamping openings 78 are adjusted to each other, so that as soon as the clamping elements 76 are latched in, the sides 60 and 62 of the frame bands 52 and 54 or their locking rails 64 and 66 which are positioned next to each other are subjected to a certain degree of pressure force.

As can further be seen from FIG. 7, a locking lid 80 can simultaneously serve as a transport handle. If the inner sides 60 and 62 of the frame bands 52 and 54 are positioned next to each other, the locking lid shown 80 can be placed over the locking slit and the second clamping element 94 can be latched into a third clamping opening 84. As a result, at least a section of the upper side of the coupling lock 50 is covered and protected against contamination on the one hand, while on the other, in addition to, or as an alternative to, the function of the first clamping element 76 and the first clamping opening 78, a further securing mechanism for the lock is provided. The locking lid or the transport handle 80 is here connected with the outer side of the frame band 52 or 54 via a holding band 96. This band 96 is usually essentially vertically positioned to the outer side, and comprises at least one second clamping opening 82. A first handle element 90 is connected to the band 96 via a first film hinge 86. A second handle element 92, which forms an upper handle panel, is connected via a second film hinge 88 with the first handle element 90. The second handle element 92 can in an embodiment be dimensioned in such a way that a second clamping element 94 located on its outer edge can latch into the second clamping opening 82 as soon as the second handle element 92 is folded onto the first handle element 90.

In order for a particularly reliable connection from the coupling lock 50 to a second coupling lock 50' (not shown) to be created, temporary locking elements, which correspond with each other, are attached in the upper section of the frame band 52. Therefore, in each case, third clamping openings 84 in the form of long opening slits are positioned along the upper edge of a narrow side 52 and a long side 54 of the coupling lock 50. These clamping openings 84 are attached in wall elements which extend over the upper sides 68, 70 of the frame bands 52 and 54. Several latching elements 98 are positioned along the upper section of the remaining frame bands 52 and 54 of the coupling lock 50, which comprise no openings 84. If two coupling locks 50 and 50' are now coupled with each other, these latching elements 98 latch into corresponding third clamping openings 84' of a second coupling lock 50'. Here, it has been shown to be advantageous when the wall elements which hold the third clamping openings 84 are separated from each other by material outlets 99, to ensure a high degree of flexibility during the latching procedure. These material outlets 99 are naturally fitted in such a way that they do not permit penetration into the inner area of the coupling locks, and are preferably incorporated into narrow-sided extensions 74 of the frame bands. Furthermore, it is naturally sufficient when the clamping openings 84, 84' are concavities for retaining the latching elements 98, 98', which do not penetrate the wall of the frame band in the form of holes.

Figure 8:
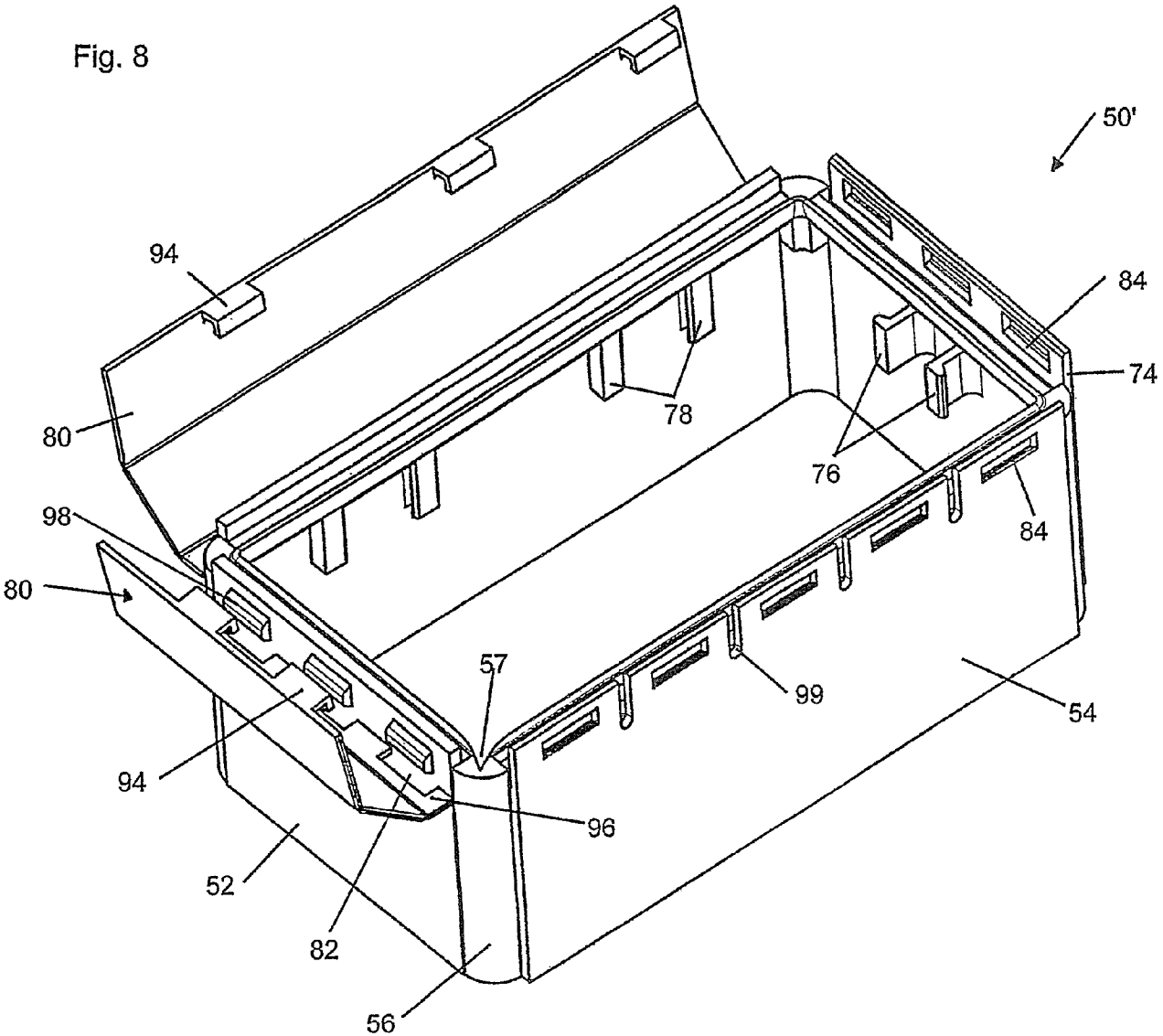
FIG. 8 shows a schematic perspective view of an alternative embodiment of the coupling lock according to FIG. 7.

A particularly tight environmental seal is also achieved when locking the coupling lock 50 when at least two opposite joints 56 each comprise at least one notch 57 on their inner sides, at least partially, in particular in the upper section, i.e. starting from the upper side 68, 70 of the frame bands 52, 54. As an example, only one joint 56 is shown in each case in FIGS. 7 and 8, which comprises a notch 57 of this type. These joints 56 which comprise opposing notches 57 are particularly suitable for use as opposite end sections of a locked coupling lock 50. Here, adjacent frame bands 52 and 54 touch each other in each case to form an angle of 0°, while the adjacent joints 56, which comprise no notches, connect frame bands 52 and 54 with each other, which form an angle of approximately 180° when the coupling lock 50 is closed. The use of at least two joints 56 containing notches 57 on their inner sides, at least partially, results in a particularly tight seal between the locking slit and the coupling lock 50, including for the opposite end sections. In cases when two opposite joints with notches 57 are provided for a coupling lock 50 with four frame bands 52, 54, which are only of the same length in pairs, non-identical coupling locks 50 should be regularly used in order to form a docking device. This then requires mirror symmetrical active and passive forms. In addition, it should be noted that when a coupling lock 50 is used with a pair of joints which contain notches 57, the degree of freedom of play when the frame bands 52, 54 are folded together is necessarily limited, preventing the opposite joints without notches from forming the end sections of the coupling lock which has been folded together. FIG. 8 shows a coupling lock 50' which can be coupled with the coupling lock according to FIG. 7.

Figure 9:
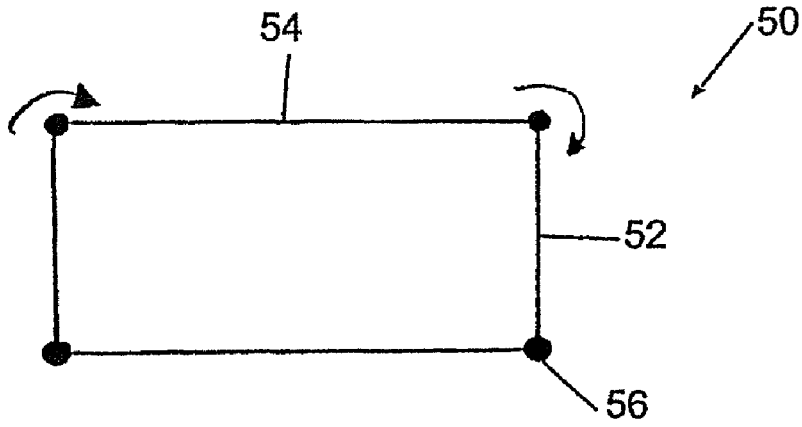
FIG. 9 shows a schematic view from above of the coupling lock according to FIG. 7.
Figure 10:
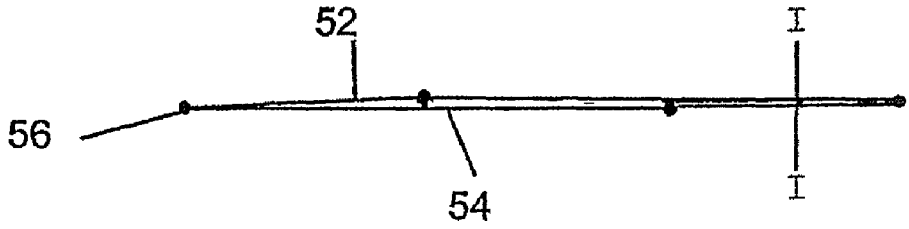
FIG. 10 shows a schematic view from above of the coupling lock according to FIG. 7 in a closed state.
Figure 11:
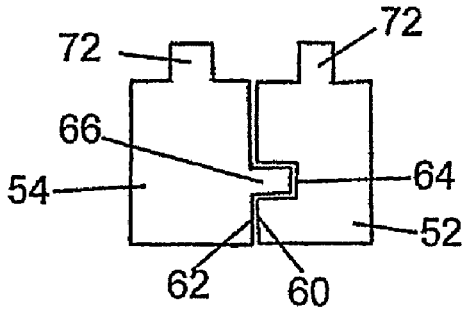
FIG. 11 shows a schematic profile view of the coupling lock according to FIG. 10 along the sectional plane I-I.

FIG. 9 is a view from above of a coupling lock 50 according to the second embodiment in a fully opened state. The frame bands 52 and 54 form the shape of a rectangle with the joints elements 56 in each corner. In a closed state, the frame bands 52 and 54, or their inner sides 60 and 62, as shown in FIG. 10, touch each other in an alignment. In order to lock the coupling lock 50, only three frame bands need to be moved regularly. FIG. 11 shows a profile view of the coupling lock 50 along the section plane I-I, in order to demonstrate how the first and second locking rails 64 and 66 interlock in an alignment when the frame bands 52 and 54 are folded one on top of the other. A first locking element 72 is already located on the upper sides 68 and 70 of the frame bands 52 and 54.

Figure 12:
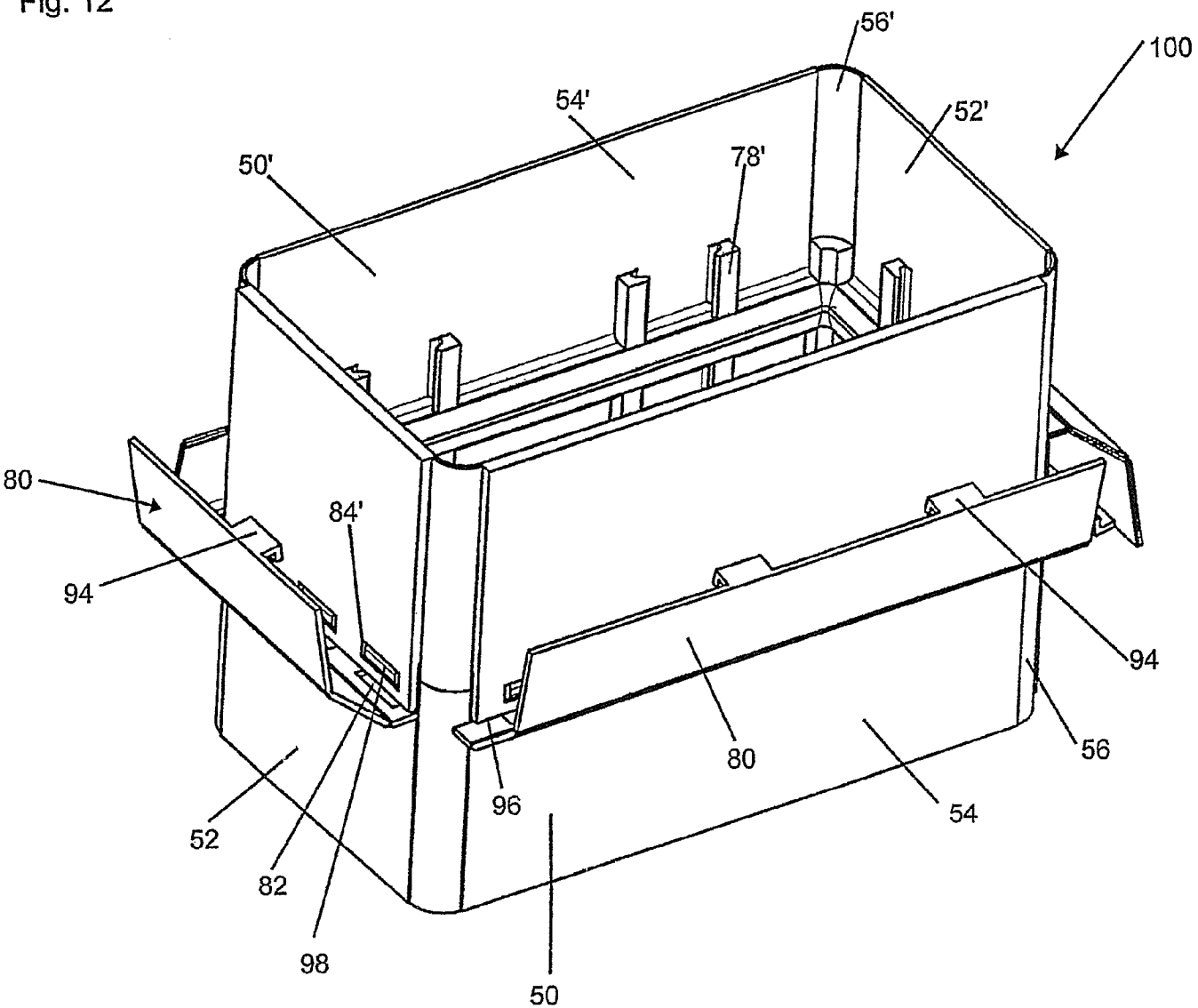
FIG. 12 shows a schematic perspective view of a further docking device.

FIG. 12 shows a second embodiment of a docking device 100, which comprises two coupling locks 50, 50' according to the second embodiment. The corresponding first locking elements 72 and 72' on the upper sides 68 and 68' of the coupling locks 50, 50' have here been interlocked in an alignment to form an environmentally sealed end. One contribution, among others, which helps create this result is made by the fact that the two coupling locks 50 and 50' are essentially identically dimensioned, in particular in relation to their folding frames 58 and 58'. The transport handles 80 can now be formed by folding out the first and second handle elements 90 and 92, and if necessary, latching the second clamping element 94 into the second clamping opening 82. These make it particularly easy for the user to handle the docking device 100 according to the second embodiment, while at the same time, the handles 80 of the coupled folding frames can be locked or opened in a particularly simple manner. A particularly tight seal is achieved when the coupling locks 50 and 50' are coupled by latching the latching elements 98 of the coupling lock 50 into the third clamping openings 84' of the coupling lock 50', thus ensuring that the docking device 100 cannot be opened without the application of external force.

Figure 13:
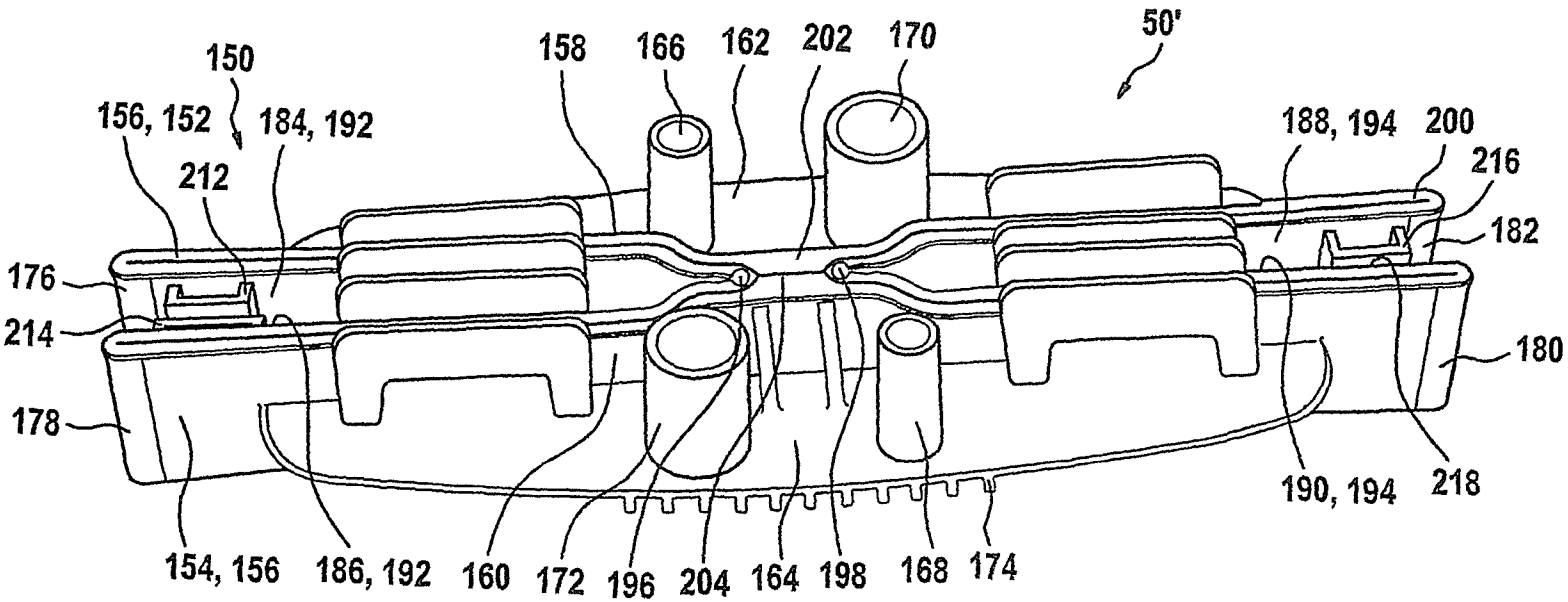
FIG. 13 shows a schematic perspective view of an alternative embodiment of a second coupling lock in a closed state.

FIG. 13 shows a perspective view of an additional further development of a coupling lock 50' according to the second embodiment in a closed state. The coupling lock 50' is shown from the outlet, or lower side. The coupling lock 50' shown comprises two opposite frame bands 152 and 154, which form the third frame band pair 156, and are fitted in each case on their outer sides 158 and 160 with an operating handle 162, 164. Each operating handle 162, 164 comprises a centering cone 166, 168 and a clamping collar 170,172. The centering cone 166, 168 is designed in such a way that it can be guided into the corresponding clamping collar of a corresponding second coupling lock (not shown). In the same way, the clamping collar 170,172 is suitable for retaining the centering cone of a corresponding second coupling lock (not shown). Here, it is of particular advantage when the inner diameter of the clamping collar, or the guide rails which are fitted on the inner wall of said clamping collar, taper as they extend away from the opening and/or when the centering cone, or the guide rails which are fitted on the inner wall of said centering cone, widen as they extend away from the tip. In this way, corresponding coupling locks can be docked in a particularly simple and secure manner in such a way that their folding frames or sealing lips are automatically connected to the system in an environmentally sealed manner. Here, it has been shown to be of particular advantage when the two operating handles 162, 164 on the outer sides of the frame bands 152, 154 of the third frame band pair 156 comprise the clamping and centering aids described above. In order to reinforce the operating handles 162, 164, these can comprise traverse ribs 174. The frame bands 152, 154 of the third pair are connected in each case with short frame bands 184, 186 and 188, 190 from the first or second frame band pair 192, 194 via elastic joint elements 176, 178, 180, 182. As a result, the first frame band 184 of the first frame band pair 192 is connected to the first frame band 152 of the third frame band pair 156 via a joint element 176 on one end and to the first frame band 188 of the second frame band pair 194 via a joint element 182 on the opposite end of the first frame band 152 of the third frame band pair 156. In the same way, the second frame bands in each case 186 and 190 from the first or second frame band pair 192, 194 are connected with the second frame band 154 of the third frame band pair 156, in each case via a joint element 178 or 180. An encompassing folding frame 58' is now attained due to the fact that the first and second frame bands 184, 186 of the first pair 192 and the first and second frame bands 188, 190 of the second pair 194 are connected with each other, in each case via a joint element 196 or 198. In the present embodiment, the first and second frame bands 184, 186, 188 and 190 from the first and second frame band pair 192, 194, fold inwards when locked, and their corresponding joint elements 196, 198 move towards each other.

On the edges of the frame bands 152, 154, 184, 186 and 190, an encompassing sealing lip 200 made of elastomer material has been attached, which protrudes on the inner side over the profile dimensions of the frame bands. If the inner sides of the frame bands 184, 186, or 188, 190 of the first and second pair are moved towards the inner sides of the first and second frame bands 153, 154 of the third pair, the sealing lips on the edges of the frame bands in each case are made to touch each other, and form a tight seal.

In the present embodiment according to FIG. 13, the frame bands 184, 186 and 188, 190 of the first and second pair 192 or 194 have identical dimensions, and have a length which is shorter than half the length of the frame bands 152, 154 of the third frame band pair 156. Accordingly, the sealing lips 200 on the first and second frame band 152, 154 of the third frame pair 156 are made to touch each other in the central section of the coupling lock 50'. For this purpose, a concavity 202, 204 is fitted in each case on the contour of the first and second frame band 152, 154 of the third pair in the central section. The contours of the first and second frame band 184, 186, or 188, 190 of the first and second pair are adapted to the contour of the frame bands 152, 154 of the third pair. This contour has the advantage that it forces the folding movement of the first two frame bands of the first and second pair towards the first frame band of the third pair when the first and second frame bands of the third pair are moved towards each other. The same applies to the second frame bands of the first and second pair in relation to the second frame band of the third pair.

In a closed state, the frame bands 152, 154 of the third pair 156 are held or pressed onto each other by suitable clamping or latching locks. In a locked state, the spacers 212, 214 or 216, 218 which are provided on the outer sides of the frame bands 154, 186 and 188, 190 of the first or second pair, in each case in the area around the joint elements 176, 178, or 180, 102 are also mutually made to touch each other. These spacers are dimensioned in such a way that the total of their maximum distances from the base area of each frame band exceeds, in particular to a slight degree, the distance of the outer sides of the first and second frame bands 184, 186 of the first pair 192, or the first and second frame bands 188, 190 of the second pair 194, which essentially run in parallel and which are positioned opposite each other. As a result, when in a closed state, in particular when the first and second frame bands 152, 154 of the third pair 156 are clamped together in the central area, the section on which the first band 184 of the first pair 192 touches the first band 152 of the third pair 156, and the section on which the second band 186 of the first pair 192 touches the second band 154 of the third pair 156, are pressed apart using the spring elasticity of the pair of frame bands which are touching each other, in each case at a distance away from the central area of the clamped third frame band pair 156. The same mechanism is used with the bands 188, 190 of the second pair 194. In this way, the sealing lips 200 of the frame bands, which are already touching each other, are pressed together even more strongly, in particular in the area of the outer joint elements 176, 178 and 180, 182.

Figure 14:
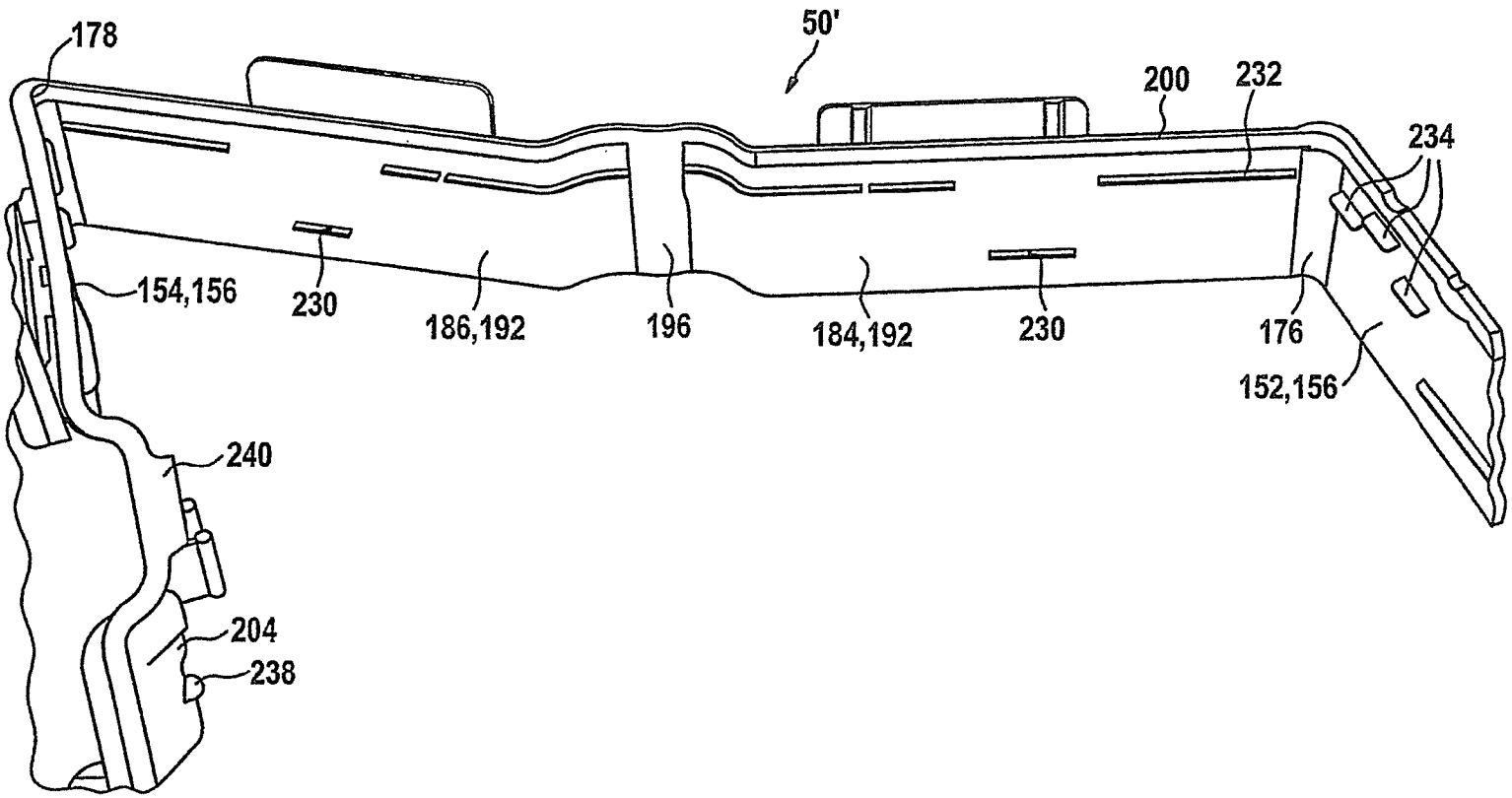
FIG. 14 shows a schematic perspective view of the coupling lock according to FIG. 13 in an opened state.

FIG. 14 shows a cross-section of a coupling lock 50' according to FIG. 13 in an open state. The first and second frame bands 184, 186 of the first pair 192 can be recognized, which are connected with the first or second frame band 152, 154 of the third pair 156 via joint elements 176, 178. The inner sides of the first and second frame bands 184, 186 of the first pair 192 each comprise spacers 230 in the area below the central axis. These fulfil the function, when they are made to touch the inner side of the first or second frame band 152, 154 of the third pair 156, of holding the frame bands in each case essentially in a parallel alignment. This is because the inner sides of the frame bands do not generally touch fully, due to the sealing lip 200 which protrudes on the inner side over the edge. The attachments 238 provided below the central axis in the area of the concavities 202, 204 of the first and second band 152, 154 of the third frame band pair fulfill the same function. Furthermore, the inner sides of the frame bands of the first to third frame band pair comprise adjusting elements 232, 234 which can be interlocked, and which ensure that the sealing lips 200 which touch each other on adjacent frame bands are always positioned at the same height over the entire length in a closed state. Suitable adjusting elements 232, 234 can be strip-shaped protrusions, for example, which, when they are made to touch the inner side of the adjacent frame band, are retained on their lower and/or upper side by corresponding adjusting elements on the opposite inner side. In order for the first and second bands 152, 154 of the third frame band pair 156 which are made to touch each other in the central area to guarantee a tight seal, the sealing lip 200 is fitted on the inside with corresponding sealing tongues 240, 242 (not shown), in each case to a greater extent than for standard sealing rings.

Figure 15:
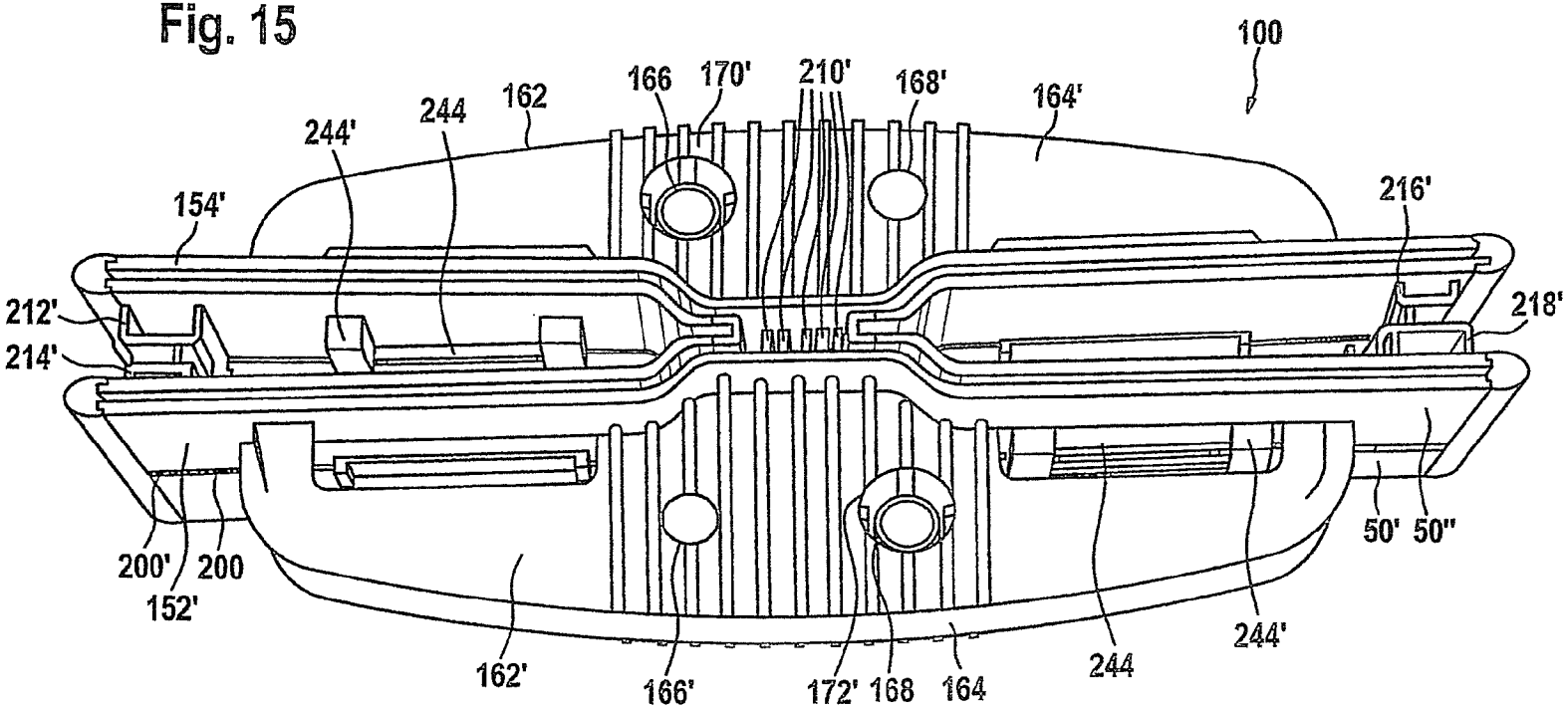
FIG. 15 shows a schematic perspective view of a further embodiment of a docking device.

FIG. 15 represents a docking device 100 according to FIG. 13, comprised of two identical coupling locks 50', 50". The first and second frame bands 152', 154' of the third frame band pair of the upper coupling lock are firmly connected with each other via clamping or latching mechanisms 210', yet in such a manner that they can be released. The centering cone 166, 168, which are positioned on opposite operating handles 162, 164 of the lower coupling lock 50' are guided into the clamping collars 170', 172' of the operating handles 162', 164' of the upper coupling lock 50". The same applies to the centering cone 166', 168' of the upper coupling lock 50", which are positioned in the clamping collars 170, 172 of the lower coupling lock 50'. In this way, the encompassing sealing lips 200 and 200' on the lower and upper coupling lock 50 and 50' are automatically made to touch without any further adjustment stages being necessary. The upper and lower coupling locks 50 or 50' are connected to each other to form a docking device 100 by interlocking locking elements 244 and 244' on the outer sides of the frame bands which latch reversibly into each other.

A flexible container or conveyance unit can either be attached on the outer or inner side along the frame bands of the folding frame 58", for example using adhesion, welding, clipping or latching. The docking device 100 according to FIG. 15 can easily be separated when in a closed state. In the same way, the coupling locks 50, 50' which form this docking device can also easily be tightly connected with each other again. Furthermore, it is easily possible to transfer the docking device 100 from a closed state to an open state by pulling apart the first and second frame bands 152, 152', 154, 154' of the third frame band pair 156, 156'.

Figure 16:
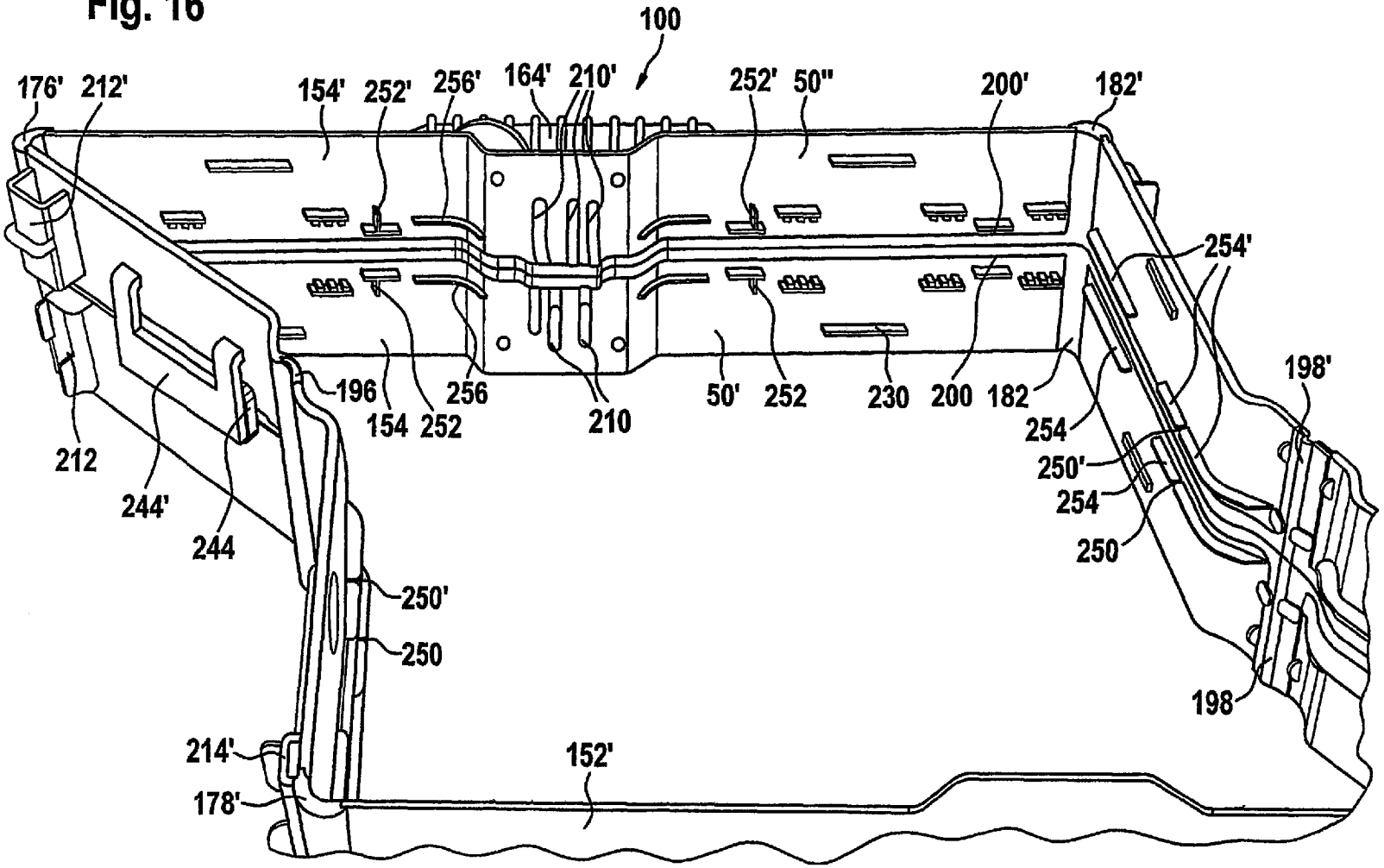
FIG. 16 shows a schematic perspective view of a docking device according to FIG. 15 in an opened state.

FIG. 16 shows the docking device according to FIG. 15 in an open state. The sealing lips 200 and 200' on the lower and upper folding frames 58' and 58" are still constantly touching each other. In addition, positioning aids 250 and 252 or 250' and 252' which correspond to each other can be provided on the inner sides of the frame bands of the folding frames 58' and 58", which prevent the shorter frame bands of a folding frame being moved sideways against the longer frame band of the third frame band pair of a folding frame when in a closed state. For this purpose, protrusions or seams 252' are provided in the coupling lock 50", which run on the frame band 154' parallel to the longitudinal axis of the joint elements 176' or 182'. These protrusions grip into recesses 250' which are provided on the inner side of the adjacent frame bands of the first and second frame band pair in corresponding notches 250'. Insofar as the protrusion 252' and the notch 250' are made to fit precisely, relative movements of frame bands which are adjacent to the frame band of a third frame band pair can be fully prevented, despite the relative freedom of movement of the joint elements. The same mechanism is used with the docked folding frame 58'.

The strip-shaped projections or seams 254' which are arranged approximately in parallel to the encompassing sealing lip contribute, in interaction with the seams 256 or 256', which are arranged at a slight offset, to the fact that a relative movement of the frame bands which touch each other in a closed state is also stopped vertically to the encompassing sealing lip. FIG. 16 furthermore shows clamping or latching locks 210, 210', which are provided in the area around the concavities of the frame bands of the third pair of frame bands and which are incorporated into a fixed connection, which can also be released, with the corresponding clamping or latching locks on the opposite concavity of the frame band of the third pair. This latching lock also ensures that the sealing lips 200, 200' are kept pressed against each other.

Figure 17:
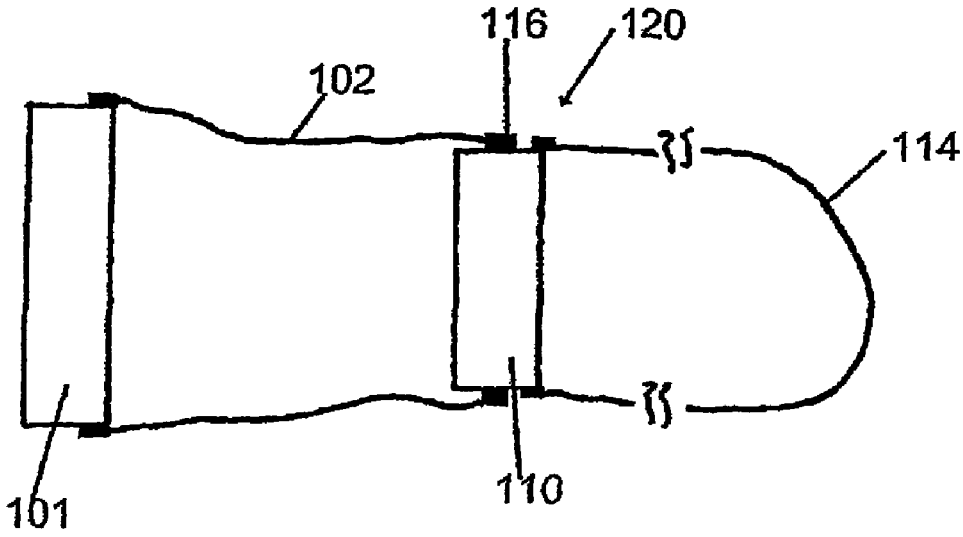
FIG. 17 shows a schematic side view of a multiple coupling lock according to the preferred embodiment.

FIG. 17 shows a schematic side view of a multiple coupling lock 120 according to the preferred embodiment. In the embodiment shown, this multiple coupling lock 120 comprises a first coupling lock 101 on the front end and a downstream second coupling locks 110. Furthermore, the first and second coupling lock 101, 110 are connected in an environmentally sealed manner with each other via a hose 102, which is flexible at least in sections. The outer diameter of the second coupling lock 110 and the inner diameter of the first coupling lock 101 or the opening area, are to be selected in such a way that when the first coupling lock 101 is open, the second coupling lock 110, in an open or closed state, can be inserted into or even inserted through the opened first coupling lock 101. The hose or hose element 102 should be selected in terms of its dimensions or length, and its flexibility, in such a way that the relative movement described above of the first and second coupling lock, 101, 110, is permitted, whereby damage to said coupling lock, or reduction in the environmental seal of the multiple coupling lock 120, must not occur. On the second coupling lock 110, for example, a hose or a flexible or rigid container 114 can be attached. The hose element 102 can be affixed to the first coupling lock 101, in particular to its outer wall, in the standard manner, such as with an adhesive and/or using a clamp connection, such as that described in the previous embodiments in FIGS. 1 to 12. The rear end of the hose element or hose 102 which points away from the opening of the multiple coupling lock 120 is itself in turn permanently or temporarily connected to the second coupling lock 110, in particular to its outer wall, or with a basic body connected with the second coupling lock 110. Insofar as a flexible or rigid container is attached to the second coupling lock 110, the hose or hose element 102 can also be temporarily or permanently affixed to these components. In particular, insofar as the second coupling lock 110 changes its outer form when opened or closed, it is advantageous when the hose element 102 is attached to a basic body or container which is supplementary to the second coupling lock 110, and which is essentially invariable in terms of its movement. This attachment 116 can for example be standard triclamp connections. With the multiple coupling lock 120 shown, the first coupling lock 101 can for example be a parallelogram coupling lock, while the second coupling lock 110 can be one which comprises a rotating closing flap which can be operated externally (not shown). Naturally, any combination of the known and previously described environmentally sealed coupling locks is possible, in order to form a multiple coupling lock 120 according to the preferred embodiment. According to a further embodiment, it is possible for the dimensions of the second coupling lock not to permit it to be inserted through the opening of the first coupling lock, but where the opening area of the second coupling lock is dimensioned in such a way that a corresponding coupling lock can be inserted through the opening of the first coupling lock and connected with the second coupling lock to form a docking device.

Figure 18:
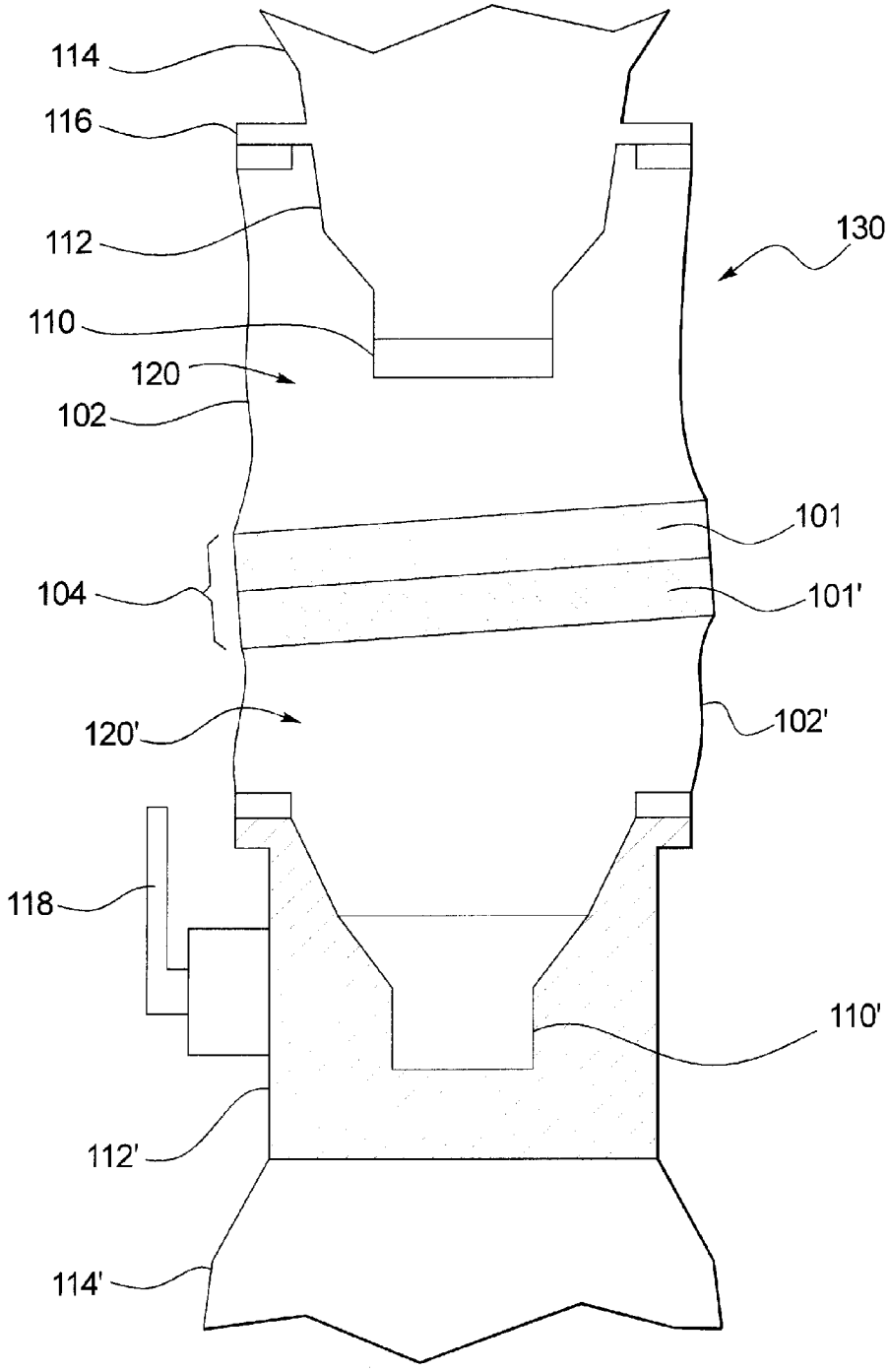
FIG. 18 shows a schematic side view of a multiple docking device according to the preferred embodiment.
Figure 19:
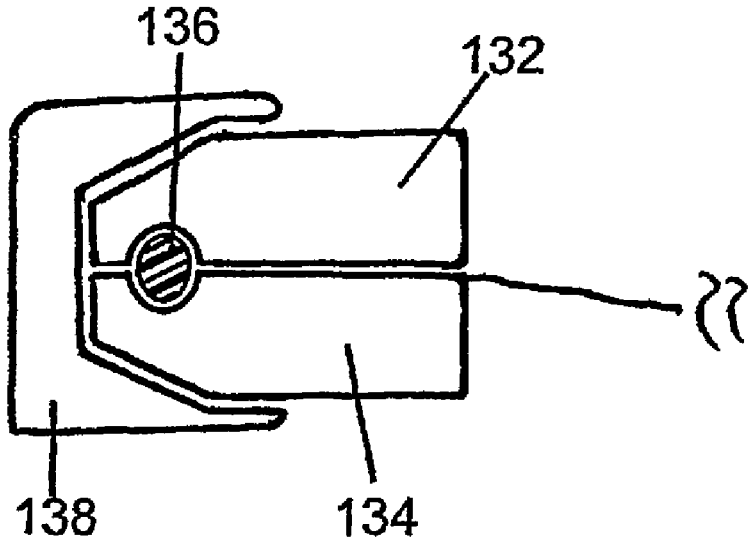
FIG. 19 shows a schematic profile view of a triclamp connection

FIG. 18 shows a multiple docking device 130 according to the preferred embodiment which is comprised of two multiple coupling locks 120 and 120'. In the embodiment shown, the first coupling locks 101, 101' are connected with each other in an environmentally sealed manner to form a first docking device 104, and are in a closed state. The first coupling locks 101, 101' are connected with the second coupling locks 110 and 110' directly or indirectly via flexible hose elements 102, 102'. In the embodiment shown, it should be assumed that the containers which are attached to the second coupling locks 110, 110' are rigid containers. The end of the hose element 102 which faces away from the first coupling lock 101 is connected in an environmentally sealed manner, for example via a so-called triclamp connection 116, with the outer wall of the container 114 or the basic body 112, 112' of the coupling locks. Here, it has been shown to be particularly user-friendly when the connection 116 is reversible, so that a multiple or dual coupling lock 120 can only be constructed when needed, for example when very high standards of cleanliness are required during refilling. Suitable triclamp connections consist, as show in FIG. 19, for example, of two triclamp components 132 and 134, of which one, 132, is firmly connected for example with the container or the basic body of the coupling lock, for example via a welded connection. The hose 102 is attached to the second triclamp component 134, for example using vibration or ultrasound welding, when this component, like the hose, is made of a synthetic material. A seal 136 which is inserted into two uniform, encompassing grooves on the triclamp components 132 and 134, ensures tight environmental sealing. The two triclamp components 132 and 134 are kept pressed together with the help of a hose clip 138. The second coupling lock 110 of the multiple coupling lock 130 according to FIG. 14 should in the present case be a rotating folding flap lock, which can lock against the atmosphere a first pipe connection using a rotating device, in particular a shaft. Accordingly, the second coupling lock 110' is a complementary system which together with the second coupling lock 110 (not shown) can form a second docking device. For this purpose, the first docking device 104 must be opened, so that that second coupling lock 110 can penetrate this opening and couple with the second coupling lock 110'. Here, the second coupling lock 110', for example, also comprises a closing flap, which can be connected firmly with the closing flap of the second coupling lock 110 to form a seal, whereby both closing flaps can then be rotated via an actuation device 118 from a closed position into an open position. After the refilling procedure has been completed, the closing flaps are brought back into the closed position using the actuation device 118, so that the subsequent pipe connections are in each case closed against the atmosphere in an environmentally sealed manner. The two coupled containers 114 and 114' can be separated from each other again when the second coupling lock 110, 110' are decoupled. In cases when bulk materials are not transferred in their entirety during this refilling procedure, or bulk materials could escape from the receptacles 114 or 114' for any other reason, particularly during decoupling, contamination of the environment is prevented by the hose elements 120 and 120', and by the environmentally sealed docking device 104 of the first coupling locks 101 and 101' of the multiple docking device 130 according to the preferred embodiment. Bulk material residues of this type can for example be removed from the inner area described by a suction device (not shown) by applying a vacuum before decoupling the docking device 104. In addition, this inner area or these partial inner areas of the hose elements 120 and 120' which can be created after the docking device 104 has been closed can first be cleaned using a cleaning agent, in particular a cleaning fluid, and then dried or evacuated. Naturally, it is also possible, after the closing flaps of the second coupling locks 110 and 110' have been closed and the second docking device or inner area of the hose element 120 has been decoupled, to first transfer the remaining bulk materials mechanically into the inner area of the hose element 120', to close the docking device 104, if necessary, to decouple it, and to transfer the bulk materials now in the inner area of the hose element 120' by opening the closing flap of the actuation device 118, for example by the force of gravity, into the container 114'. The hose element 120' and/or the coupling lock 110' should preferably create a cone or funnel shaped form or junction in the direction of the opening of this coupling lock for this purpose. A high level of security can be achieved when the hose elements 120 and 120' are at least partially transparent. After the refilling procedure has been completed, the hose elements 120 and 120' are released from the walls of the receptacles or coupling locks, and are then available for further use with other receptacles which can be coupled.

While preferred embodiments have been illustrated and described in detail in the drawings and foregoing description, the same are to be considered as illustrative and not restrictive in character, it being understood that only the preferred embodiments have been shown and described and that all changes and modifications that come within the spirit of the invention both now or in the future are desired to be protected.

We claim:

1. A multiple coupling lock system for an environmentally sealed filling or refilling of a first container or a first hose, comprising:

a first coupling lock having an opening area which is opened;

a first flexible conveyance unit having a first end connected to said first coupling lock in an environmentally sealed manner;

a second end of the first flexible conveyance unit connecting to a second coupling lock in an environmentally sealed manner, said opening area of said first coupling lock being sufficiently large when opened to allow said second coupling lock to pass therethrough;

said second coupling lock connecting in an environmentally sealed manner to said first container or first hose; and the first coupling lock comprises at least a first flexible band with at least one locking element on its inner side and at least a second flexible band with at least one second locking element on its inner side which is complementary to the first locking element which enables reversible, tight closure, and an upper side of the first band having at least a third locking element and an upper side of the second band having at least a fourth locking element.

2. A multiple coupling lock system of claim 1 wherein a second flexible conveyance unit is connected in environmentally sealed manner at a first end to said first coupling lock opposite said first flexible conveyance unit and a second end of said second flexible conveyance unit being connected in an environmentally sealed manner to a third coupling lock connectible with said second coupling lock, said third coupling lock being connected in an environmentally sealed manner to a second container or second hose.

3. A multiple coupling lock system of claim 2 wherein a fourth coupling lock connects said second conveyance unit first end to said first coupling lock by docking with said first coupling lock.

4. A multiple coupling lock system of claim 3 wherein said fourth coupling lock has an opening area which when opened is sufficiently large to allow said second coupling lock to pass therethrough.

5. A multiple coupling lock system of claim 4 wherein said first and fourth coupling locks have opening areas are openable and closeable.

6. A multiple coupling lock system of claim 1 wherein the first coupling lock opening area is closable by collapsing the first coupling lock.

7. A multiple coupling lock system of claim 1 wherein said first flexible conveyance unit comprises a hose.

8. A multiple coupling lock system of claim 1 wherein the first coupling lock comprises at least a fifth locking element on at least one outer side of the first and second bands, respectively.

9. A multiple coupling lock system of claim 8 wherein the first coupling lock comprises a locking lid containing at least a sixth locking element complementary to the fourth locking element of the upper side of the second band, the sixth locking element being connectible to the fourth locking element to form a temporary cover for a selection slit of the first and second bands when the inner sides of the first and second bands are connected with each other via a reciprocal reaction between the first and second locking elements.

10. A multiple coupling lock system of claim 9 wherein the locking lid is connected with the first or second band.

11. A multiple coupling lock system according to claim 1 wherein the first container or first hose connects at an opening edge of the first coupling lock with the first and second bands.

12. A multiple coupling lock system of claim 1 wherein an inner side or an outer side of the first or second bands comprises a bonding or adhesive layer.

13. A multiple coupling lock system of claim 1 wherein the second coupling lock comprises a closing flap with a first pipe connection, the closing flap being able to be brought to a closed position in which a first end of the pipe connection is locked.

14. A method for an environmentally sealed filling or refilling of a first container or a first hose, comprising the steps of:

providing a first coupling lock having an opening area which is opened;

providing a first flexible conveyance unit having a first end connected to said first coupling lock in an environmentally sealed manner;

providing a second end of the first flexible conveyance unit connecting to a second coupling lock in an environmentally sealed manner, said opening area of said first coupling lock being sufficiently large when opened to allow said second coupling lock to pass therethrough;

providing said second coupling lock connecting in an environmentally sealed manner to said first container or first hose;

moving said second coupling lock through said first coupling lock while flexing said first flexible conveyance unit;

providing a second flexible conveyance unit connected in an environmentally sealed manner at a first end to said first coupling lock opposite said first flexible conveyance unit and a second end of said second flexible conveyance unit being connected in an environmentally sealed manner to a third coupling lock connectible with said second coupling lock, said third coupling lock being connected in environmentally sealed manner to a second container or a second hose, and connecting said second coupling lock with said third coupling lock by moving said second coupling through said first coupling lock; and upon connection of the second and third coupling locks performing a rinse with a cleaning fluid through the second and third coupling locks.

15. A method of claim 14 including the steps of providing a fourth coupling lock connecting said second conveyance unit first end to said first coupling lock by docking with said first coupling lock, and connecting said second and third coupling locks by moving the second coupling lock through the docked first and fourth coupling locks.

16. A method of claim 15 including the step of providing said fourth coupling lock with an opening area which when opened is sufficiently large to allow said fourth third coupling lock to pass therethrough.

17. A method of claim 14 wherein a suction is provided for transfer of medium from said second container or second hose to said first container or first hose or vice versa when said second and third coupling locks are connected.

18. A method of claim 14 wherein said first or second containers or hoses are flexible.

* * * * *